US010370791B2

(12) United States Patent
Hotta et al.

(10) Patent No.: US 10,370,791 B2
(45) Date of Patent: Aug. 6, 2019

(54) SYNTHETIC FIBER FINISH AND APPLICATION THEREOF

(71) Applicant: MATSUMOTO YUSHI-SEIYAKU CO., LTD., Osaka (JP)

(72) Inventors: Masato Hotta, Osaka (JP); Masami Okuzawa, Osaka (JP)

(73) Assignee: MATSUMOTO YUSHI-SEIYAKU CO., LTD., Osaka (JP)

( * ) Notice: Subject to any disclaimer, the term of this patent is extended or adjusted under 35 U.S.C. 154(b) by 120 days.

(21) Appl. No.: 15/548,215

(22) PCT Filed: Jan. 19, 2016

(86) PCT No.: PCT/JP2016/051377

§ 371 (c)(1),
(2) Date: Aug. 2, 2017

(87) PCT Pub. No.: WO2016/125577

PCT Pub. Date: Aug. 11, 2016

(65) Prior Publication Data

US 2018/0030649 A1 Feb. 1, 2018

(30) Foreign Application Priority Data

Feb. 6, 2015 (JP) ..... 2015-022146

(51) Int. Cl.

| | |
|---|---|
| ***D06M 13/224*** | (2006.01) |
| ***D06M 15/53*** | (2006.01) |
| ***D06M 13/256*** | (2006.01) |
| ***D06M 13/17*** | (2006.01) |

(52) U.S. Cl.

CPC ..... *D06M 13/2243* (2013.01); *D06M 13/17* (2013.01); *D06M 13/224* (2013.01); *D06M 13/2246* (2013.01); *D06M 13/256* (2013.01); *D06M 15/53* (2013.01); *D06M 2200/30* (2013.01)

(58) Field of Classification Search

CPC ..... D06M 13/2243; D06M 13/2246; D06M 13/256; D06M 15/53; D06M 2200/30

See application file for complete search history.

(56) References Cited

FOREIGN PATENT DOCUMENTS

| | | | |
|---|---|---|---|
| JP | 54-147214 | | 11/1979 |
| JP | 61-672 | * | 1/1986 |
| JP | 8-120563 | | 5/1996 |
| JP | 8-120564 | | 5/1996 |
| JP | 8-199432 | | 8/1996 |
| JP | 9-188968 | * | 7/1997 |
| JP | 2003-20566 | | 1/2003 |
| JP | 2009-185421 | | 8/2009 |
| JP | 5793607 | | 10/2015 |
| WO | 2014/024647 | | 2/2014 |
| WO | 2015/186545 | | 12/2015 |
| WO | 2016/021211 | | 2/2016 |

OTHER PUBLICATIONS

International Search Report, dated Apr. 19, 2016 in corresponding International Application No. PCT/JP2016/051377.

* cited by examiner

*Primary Examiner* — Robert D Harlan
(74) *Attorney, Agent, or Firm* — Wenderoth, Lind & Ponack, L.L.P.

(57) ABSTRACT

A synthetic fiber finish includes a lubricant (A), a polyhydric alcohol fatty acid ester having at least one hydroxyl group per molecule (B), and an organic sulfonic acid compound (C). The lubricant (A) includes a sulfur-containing ester (A3). The amount of the lubricant (A) ranges from 50 to 90 wt %, the amount of the ester (B) ranges from 1 to 20 wt % and the amount of the sulfur-containing ester (A3) ranges from 5 to 20 wt %, to a nonvolatile component of the finish.

20 Claims, 1 Drawing Sheet

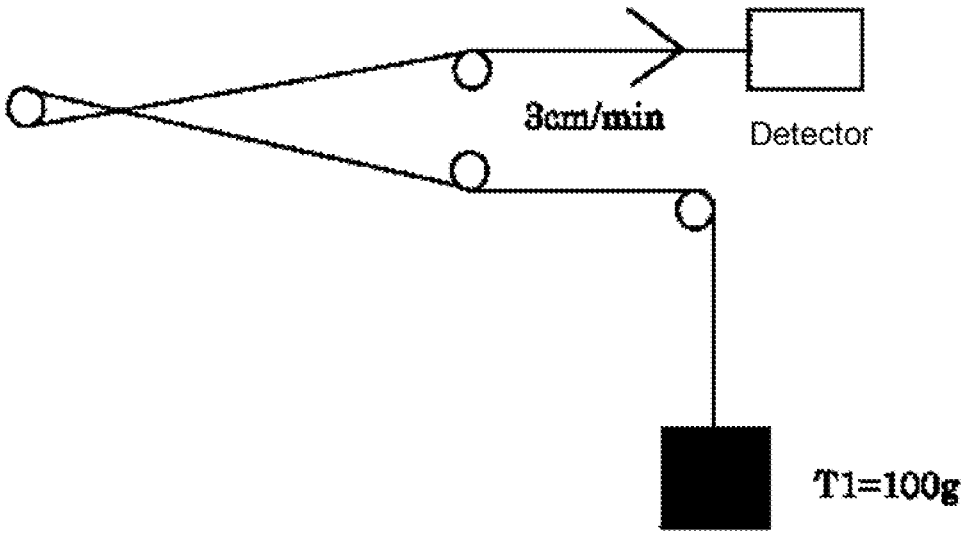
3cm/min
Detector
T1=100g

SYNTHETIC FIBER FINISH AND APPLICATION THEREOF

TECHNICAL FIELD

The present invention relates to a synthetic fiber finish and application thereof.

BACKGROUND ART

Recently, airbag systems for vehicle safety device are increasingly installed in automobiles. The increasing demand for vehicle safety accelerates the installment of new types of airbags in automobiles, such as side airbags and side curtain airbags which protect passengers from the impact by side crash, in addition to conventional driver and front passenger airbags.

The side airbags and side curtain airbags are required to be highly airtight, because they must retain their form for several to about 10 seconds after their deployment in order to hold passengers at the event of side crash or overturn of automobiles. Thus coated airbags made of silicone-resin-coated fabric are employed for their improved airtightness.

Base fabrics for airbags are woven with synthetic yarns, and the finishes on the yarns are removed from the fabrics in scouring process. Fabrics woven with water-jet looms are not subsequently scoured because water jet in weaving process removes the finishes.

For manufacturing coated airbags, finishes remaining in base fabrics may cause insufficient adhesion between the base fabrics and silicone resins leading to insufficient airtightness of resultant airbags. Thus finishes remaining in base fabrics must be completely removed for manufacturing quality airbags. On the other hand, the demand for space-saving compact airbags is increasing for saving fuel consumption of automobiles.

For meeting the demand of compact airbags, low-density base fabrics must be woven with low-fineness yarns, and the strength of the low-density base fabrics is maintained by increasing the tenacity of the low-fineness yarns.

The tenacity of the yarns can be increased by increasing the draw ratio and the temperature of draw rolls in spinning synthetic filament for the yarns. The increased draw roll temperature may cause the troubles due to stain on draw rolls, such as broken filament and ends down, which were not identified as the troubles in the conventional spinning processes.

PTL 1 discloses a spin finish for filament yarns to be processed into base fabrics for quality silicone-coated airbags. The finish contains 50 to 70% of monohydric fatty acid ester with M.W. of 500 to 700, 15 to 35% of EO/PO polyether with M.W. of 1000 to 2000, 0.1 to 3.0% of a hindered phenol antioxidant, 0.1 to 2.0% of an organic phosphate ester, 0.5 to 2.0% of an organic sulfur compound and 0.1 to 1.0% of a silicone compound. The finish in the PTL 1, however, generates much fume on high-temperature rolls required recently in spinning process, and causes troubles including poor working environment and broken filament due to poor heat resistance of the finish.

PTL 2 discloses a spin finish containing 30 to 50% of the ester derived from a dibasic acid and a monohydric alcohol, 20 to 50% of the ester derived from a monobasic acid and a compound having at least three hydroxyl groups per molecule, 1 to 10% of the ester polymer with M.W. of 10000 to 30000 derived from a dibasic acid and a compound having at least three hydroxyl groups per molecule, and 0.5 to 5% of alkyl phosphate amine salt with M.W. of 1000 to 2000 for producing polyamide fiber useful for manufacturing airbags. The spin finish containing the ester polymer of high M.W. described in PTL 2, however, could not be removed sufficiently from the fabric of the yarn applied with the finish in scouring or in weaving with water-jet looms, and the fabric could not be well adhered with silicone resins.

PTL 3 discloses a finish composition for producing a thermoplastic synthetic fiber, which contains the diester of thiodipropionic acid and $C_{12}$-$C_{18}$ monohydric alcohol and POE (10 to 45) castor oil or hydrogenated castor oil in a weight ratio from 4:1 to 2:3. The airbag fabric made of the synthetic fiber applied with the finish resulted in insufficient adhesion of the fabric and silicone resins due to high amount of the total sulfuric acid in the finish.

CITATION LIST

Patent Literature

[PTL 1] Japanese Unexamined Patent Application Publication No. 2009-185421

[PTL 2] Japanese Unexamined Patent Application Publication No. 2003-20566

[PTL 3] Japanese Unexamined Patent Application Publication No. 1979-147214

SUMMARY OF INVENTION

Technical Problem

The present invention aims to provide a synthetic fiber finish having high heat resistance and contributing to good adhesion of silicone resins to fiber produced with the finish; a process for producing a synthetic filament strand applied with the finish; and a textile product containing the synthetic filament strand produced in the process.

Solution to Problem

The inventors of the present invention have diligently studied and found that the problems mentioned above can be solved by the synthetic fiber finish containing a lubricant (A), a specific polyhydric alcohol fatty acid ester (B) and an organic sulfonic acid compound (C) in a specific ratio.

Specifically, the present invention provides a synthetic fiber finish essentially containing the lubricant (A), the polyhydric alcohol fatty acid ester having at least one hydroxyl group per molecule (B) and the organic sulfonic acid compound (C); wherein the lubricant (A) includes a sulfur-containing ester (A3); and wherein the amount of the lubricant (A) ranges from 50 to 90 wt %, the amount of the ester (B) ranges from 1 to 20 wt % and the amount of the sulfur-containing ester (A3) ranges from 5 to 20 wt %, to the nonvolatile component of the finish.

The amount of the total sulfuric acid in the nonvolatile component of the finish should preferably range from 0.1 to 3 wt %.

The nonvolatile component of the finish should preferably contain sulfate ion ($SO_4^{2-}$) and chlorine ion (CO respectively in an amount of not higher than 300 ppm, which is detected in the nonvolatile component of the finish by ion chromatography.

The polyhydric alcohol constituting the polyhydric alcohol fatty acid ester (B) should preferably contain at least one selected from diglycerin and triglycerin.

The finish should preferably contain an alkyl polyether (D).

The synthetic fiber should preferably a fiber for airbags.

The synthetic filament strand of the present invention is produced by applying the synthetic fiber finish to a base synthetic filament strand.

The process for producing the synthetic filament strand of the present invention includes a step of applying the finish according to any one of claims 1 to 6 to a base synthetic filament strand.

The textile product of the present invention contains the synthetic filament strand mentioned above and/or the synthetic filament strand produced in the process mentioned above.

Advantageous Effects of Invention

The synthetic fiber finish of the present invention has high heat resistance and is readily removed from fiber. Thus the finish is advantageous to produce synthetic filament strand which contains minimum broken filament and is processed into a fabric to which silicone resins adhere firmly.

The synthetic filament strand of the present invention contains minimum broken filament and is processed into a textile product which contains minimum finish after weaving. The textile product of the present invention has high quality.

BRIEF DESCRIPTION OF DRAWINGS

FIG. 1 Schematic diagram of a tester for measuring yarn-to-yarn static friction

DESCRIPTION OF EMBODIMENTS

The synthetic fiber finish of the present invention essentially contains the lubricant (A), the polyhydric alcohol fatty acid ester having at least one hydroxyl group per molecule (B) and the organic sulfonic acid compound (C) in a specific ratio. The finish is described below in detail.

Lubricant (A)

The lubricant (A) is an essential component of the finish of the present invention. Examples of the lubricant (A) include (1) an ester (A1) having a structure formed by the esterification of an aliphatic monohydric alcohol and fatty acid, (2) at least one ester (A2) selected from the group consisting of the esters having a structure formed by the esterification of an aliphatic polyhydric alcohol and fatty acid and the esters having a structure formed by the esterification of an aliphatic monohydric alcohol and aliphatic polycarboxylic acid, and (3) a sulfur-containing ester (A3).

The lubricant (A) is an ester having an ester bond and no polyoxyalkylene groups and hydroxyl groups per molecule.

The lubricant (A) imparts good lubricity to fiber, in other words, attains low fiber-to-metal friction in fiber production process owing to the absence of a polyoxyalkylene group and hydroxyl group per molecule.

1) Ester (A1)

The ester (A1) is a compound having a structure formed by the esterification of an aliphatic monohydric alcohol and fatty acid (aliphatic monocarboxylic acid) and has no polyoxyalkylene groups and hydroxyl groups per molecule. One of or a combination of at least two of the esters (A1) may be used.

The ester (A1) should preferably be a compound represented by the following chemical formula.

[Chem. 1]

$$R^1—COO—R^2 \quad (1)$$

where $R^1$ represents $C_4$-$C_{24}$ alkyl or alkenyl group, and $R^2$ represents $C_6$-$C_{24}$ alkyl or alkenyl group.

The carbon number of $R^1$ preferably ranges from 6 to 22, more preferably from 8 to 20, and most preferably from 10 to 18. An alkyl or alkenyl group having a carbon number less than 4 results in weak finish film on fiber surface which leads to increased broken filament, while an alkyl or alkenyl group having a carbon number more than 24 results in high fiber-to-metal friction which also leads to increased broken filament $R^1$ may be alkyl group or alkenyl group, and alkyl group is preferable for formulating a finish with high heat resistance.

The carbon number of $R^2$ preferably ranges from 6 to 22, more preferably from 8 to 20, and most preferably from 10 to 18. An alkyl or alkenyl group having a carbon number less than 6 may result in weak finish film on fiber surface which leads to increased broken filament, while an alkyl or alkenyl group having a carbon number more than 24 may result in high fiber-to-metal friction which also leads to increased broken filament. $R^2$ may be alkyl group or alkenyl group, and alkenyl group is preferable for forming stronger finish film on fiber surface to prevent broken filament.

The ester (A1) is not specifically restricted, and examples thereof include, for example, 2-decyltetradecanoyl erucate, 2-decyltetradecanoyl oleate, 2-octyldodecyl stearate, isooctyl palmitate, isooctyl stearate, butyl palmitate, butyl stearate, butyl oleate, isooctyl oleate, lauryl oleate, isotridecyl stearate, hexadecyl stearate, isostearyl oleate, oleyl octanoate, oleyl laurate, oleyl palmitate, oleyl stearate and oleyl oleate. Of those esters, 2-decyltetradecanoyl oleate, 2-octyldodecyl stearate, isooctyl palmitate, isooctyl stearate, lauryl oleate, isotridecyl stearate, hexadecyl stearate, isostearyl oleate, and oleyl oleate are preferable.

The ester (A1) can be prepared by synthesizing a commercially available fatty acid and aliphatic monohydric alcohol in a known process.

2) Ester (A2)

The ester (A2) is at least one ester selected from the group consisting of the compounds having a structure formed by the esterification of an aliphatic polyhydric alcohol and fatty acid (aliphatic monocarboxylic acid) and the compounds having a structure formed by the esterification of an aliphatic monohydric alcohol and aliphatic polycarboxylic acid. The ester (A2) has no polyoxyalkylene groups and hydroxyl groups per molecule. One of or a combination of at least two of the esters (A2) may be used.

The ester (A2) is distinguished from the ester (B) mentioned later by the absence of hydroxyl groups in the molecule.

The aliphatic polyhydric alcohol constituting the ester (A2) has at least two hydroxyl groups per molecule, and is not specifically restricted. One of or a combination of at least two of the aliphatic polyhydric alcohols may be used. The polyhydric alcohol should preferably have at least three hydroxyl groups, more preferably three or four hydroxyl groups, and further more preferably three hydroxyl groups per molecule in order to form sufficiently strong finish film.

Examples of the aliphatic polyhydric alcohol include, for example, ethylene glycol, diethylene glycol, triethylene glycol, propylene glycol, dipropylene glycol, tripropylene glycol, 1,2-butanediol, 1,3-butanediol, 1,4-butanediol, 2-methyl-1,3-propanediol, 1,5-pentanediol, 1,6-hexanediol, neopentyl glycol, cyclohexane diol, cyclohexanedimethanol, glycerin, trimethylol propane, pentaerythritol, erythritol, diglycerin, sorbitan, sorbitol, ditrimethylol propane, dipentaerythritol, triglycerin, tetraglycerin, and sucrose. Of those polyhydric alcohols, glycerin, trimethylol propane, pentaerythritol, erythritol, diglycerin, sorbitan, sorbitol, ditrimethylol propane, dipentaerythritol and sucrose are preferable; glycerin, trimethylol propane, pentaerythritol, erythritol, diglycerin and sorbitan are more preferable; and glycerin and trimethylol propane are further more preferable.

The fatty acid constituting the ester (A2) may be either saturated or unsaturated. The number of unsaturated bonds contained in the fatty acid is not specifically restricted, and should preferably be one or two because a fatty acid containing three or more unsaturated bonds results in increased viscosity of resultant fiber finish due to the oxidation and degradation of the fatty acid ester to deteriorate the lubricity of the finish. The carbon number of the fatty acid should preferably range from 8 to 24, more preferably from 10 to 20, and further more preferably from 12 to 18. One of or a combination of at least two of the fatty acids and a combination of a saturated and unsaturated fatty acids may be employed.

Examples of the fatty acid include, for example, butyric acid, crotonic acid, valeric acid, caproic acid, enanthic acid, caprylic acid, pelargonic acid, capric acid, lauric acid, myristic acid, myristoleic acid, pentadecanoic acid, palmitic acid, palmitoleic acid, isocetylic acid, margaric acid, stearic acid, isostearic acid, oleic acid, elaidic acid, vaccenic acid, tuberculostearic acid, arachidic acid, isoeicosanoic acid, gadoleic acid, eicosenoic acid, docosanoic acid, isodocosanoic acid, erucic acid, tetracosanoic acid, isotetracosanoic acid, nervonic acid, cerotic acid, montanic acid and melissic acid.

Of those fatty acids, caprylic acid, pelargonic acid, capric acid, lauric acid, myristic acid, myristoleic acid, pentadecanoic acid, palmitic acid, palmitoleic acid, isocetylic acid, margaric acid, stearic acid, isostearic acid, oleic acid, elaidic acid, vaccenic acid, linoleic acid, lionlenic acid, tuberculostearic acid, arachidic acid, isoeicosanoic acid, gadoleic acid, eicosenoic acid, docosanoic acid, isodocosanoic acid, erucic acid, tetracosanoic acid, isotetracosanoic acid and nervonic acid are preferable; capric acid, lauric acid, myristic acid, myristoleic acid, pentadecanoic acid, palmitic acid, palmitoleic acid, isocetylic acid, margaric acid, stearic acid, isostearic acid, oleic acid, elaidic acid, vaccenic acid, tuberculostearic acid, arachidic acid, isoeicosanoic acid, gadoleic acid, eicosenoic acid are more preferable; and lauric acid, myristic acid, myristoleic acid, pentadecanoic acid, palmitic acid, palmitoleic acid, isocetylic acid, margaric acid, stearic acid, isostearic acid, oleic acid, elaidic acid and vaccenic acid are further more preferable.

The ester (A2) has at least two ester bonds per molecule, and should preferably has at least three ester bonds, and more preferably three ester bonds, per molecule for achieving good fiber production efficiency. The iodine value of the ester (A2) is not specifically restricted.

The ester (A2) should preferably contain a compound having at least three ester bonds per molecule for improved heat resistance of the resultant finish.

The weight average molecular weight of the ester (A2) should preferably range from 300 to 1200, more preferably from 300 to 1000, and further more preferably from 500 to 1000. The ester (A2) having a weight average molecular weight lower than 300 may cause insufficient finish film strength and increase broken filament or fume generation in thermal drawing. On the other hand, the ester (A2) having a weight average molecular weight higher than 1200 may cause poor finish lubricity to increase broken filament and deteriorate fiber quality so as to result in poor quality of woven and knit fabrics.

The weight average molecular weight mentioned in the present invention was calculated from the peaks measured with a refractive index detector and a high-speed gel permeation chromatography device (HCL-8220GPC, manufactured by Tosoh Corporation) in which a solution containing a sample in an amount of 3 mg/ml was charged in chromatography columns, KF-402HQ and KF-403HQ (manufactured by Showa Denko K.K.).

The ester (A2) may be synthesized from a commercially available fatty acid and aliphatic polyhydric alcohol in a known process. Natural esters extracted from fruits, seeds or flowers which meet the chemical structure of the ester (A2) may be used. The natural esters may be used without any treatment, or may be optionally refined in a known process. Furthermore the refined ester may be further refined by separation by melting point in a known process to be used for the ester (A2). In addition, an ester produced by ester-exchange reaction of at least two natural esters (fats) may be used.

The aliphatic monohydric alcohol constituting the ester (A2) is not specifically restricted, and one of or a combination of at least two of the aliphatic monohydric alcohols may be used. The aliphatic monohydric alcohol may be saturated or unsaturated. The number of the unsaturated bond per molecule of the aliphatic monohydric alcohol is not specifically restricted, and the aliphatic monohydric alcohol having one unsaturated bond per molecule is preferable because the aliphatic monohydric alcohol having two or more unsaturated bonds per molecule is more apt to be oxidized and decomposed to increase the viscosity of the resultant finish and cause poor lubricity of the finish. The aliphatic monohydric alcohol should preferably have a carbon number ranging from 8 to 24 for achieving sufficient lubricity and finish film strength of the resultant finish, more preferably from 14 to 24, and further more preferably from 18 to 22. One of or a combination of at least two of the aliphatic monohydric alcohols may be used, and a combination of a saturated aliphatic monohydric alcohol and an unsaturated aliphatic monohydric alcohol may be used.

Examples of the aliphatic monohydric alcohol include octyl alcohol, isooctyl alcohol, lauryl alcohol, myristyl alcohol, myristoleyl alcohol, cetyl alcohol, isocetyl alcohol, palmitoleyl alcohol, stearyl alcohol, isostearyl alcohol, oleyl alcohol, elaidyl alcohol, vaccenyl alcohol, gadoleyl alcohol, arachidyl alcohol, isoeicosanoyl alcohol, eicosenoyl alcohol, behenyl alcohol, isodocosanyl alcohol, erucyl alcohol, lignoceryl alcohol, isotetradocosanyl alcohol, nervonyl alcohol, cerotinyl alcohol, montanyl alcohol and melissyl alcohol. Of those alcohols, octyl alcohol, isooctyl alcohol, lauryl alcohol, myristyl alcohol, myristoleyl alcohol, cetyl alcohol, isocetyl alcohol, palmitoleyl alcohol, stearyl alcohol, isostearyl alcohol, oleyl alcohol, elaidyl alcohol, vaccenyl alcohol, gadoleyl alcohol, arachidyl alcohol, isoeicosanoyl alcohol, eicosenoyl alcohol, behenyl alcohol, isodocosanyl alcohol, erucyl alcohol, lignoceryl alcohol, isotetradocosanyl alcohol and nervonyl alcohol are preferable; myristoleyl alcohol, palmitoleyl alcohol, oleyl alcohol, elaidyl alcohol, vaccenyl alcohol, gadoleyl alcohol, eicosenoyl alcohol, erucyl alcohol and nervonyl alcohol are more preferable; and oleyl alcohol, elaidyl alcohol, vaccenyl alcohol, gadoleyl alcohol, eicosenoyl alcohol and erucyl alcohol are further more preferable.

The aliphatic polycarboxylic acid constituting the ester (A2) has at least two carboxyl groups per molecule, and is not specifically restricted. One of or a combination of at least two of the aliphatic polycarboxylic acids may be used. The aliphatic polycarboxylic acid used for the finish of the present invention does not include sulfur-containing polycarboxylic acids, such as thiodipropionic acid. The aliphatic polycarboxylic acid should preferably have two carboxyl groups and no hydroxyl groups per molecule.

Examples of the aliphatic polycarboxylic acid include citric acid, isocitric acid, malic acid, aconitic acid, oxaloacetic acid, oxalosuccinic acid, succinic acid, fumaric acid, maleic acid, glutaric acid, adipic acid, pimelic acid, suberic acid, azelaic acid and sebacic acid. Of those aliphatic polycarboxylic acids, aconitic acid, oxaloacetic acid, oxalosuccinic acid, succinic acid, fumaric acid, maleic acid, glutaric acid, adipic acid, pimelic acid, suberic acid, azelaic acid and sebacic acid are preferable, and fumaric acid, maleic acid, adipic acid, pimelic acid, suberic acid, azelaic acid and sebacic acid are more preferable.

Examples of the ester (A2) include, for example, trimethylolpropane tricaprylate, trimethylolpropane tricaprinate, trimethylolpropane trilaurate, trimethylolpropane trioleate, trimethylolpropane laurate myristylate palmitate, trimethylolpropane laurate myristylate oleate, trimethylolpropane tri-palm-kernel-fatty-acid ester, trimethylolpropane tri-coco-fatty-acid ester, coconut oil, rapeseed oil, palm oil, glycerin trilaurate, glycerin trioleate, glycerin triisostearate, sorbitan trioleate, sorbitan laurate myristylate oleate, pentaerythritol tetracaprylate, pentaerythritol tetracaprinate, pentaerythritol tetralaurate, erythritol tetralaurate, pentaerythritol tetra-palm-kernel-fatty-acid ester, pentaerythritol tetra-coco-fatty-acid ester, 1,6 hexanediol dioleate, dioctyl adipate, dilauryl adipate, dioleyl adipate, diisocetyl adipate, dioctyl sebacate, dilauryl sebacate, dioleyl sebacate and diisocetyl sebacate.

3) Sulfur-Containing Ester (A3)

The sulfur-containing ester (A3) has good lubricity and antioxidative property. The sulfur-containing ester improves the lubricity and heat resistance of the resultant finish.

The sulfur-containing ester (A3) should preferably be the compound represented by the chemical formula (2) shown below and/or the compound having a structure formed by the esterification of a thioether monocarboxylic acid and a polyhydric alcohol.

[Chem. 2]

$$R^3OOC—(CH_2)_q—S—(CH_2)_p—COOR^4 \quad (2)$$

In the chemical formula (2), $R^3$ and $R^4$ respectively represent a $C_{12}$-$C_{24}$ hydrocarbon group. $R^3$ and $R^4$ may respectively represent either a linear or branched chain, and a linear chain is preferable for decreasing the dynamic friction of filament strands imparted by the resultant finish Examples of the hydrocarbon group include alkyl and alkenyl groups, and alkenyl group is preferable. The carbon number of the hydrocarbon group should preferably range from 14 to 22 and more preferably from 16 to 20. The ester having the hydrocarbon group with a carbon number lower than 12 has excessively low molecular weight and increases fume in thermal drawing of filament strands. On the other hand, the ester having the hydrocarbon group with a carbon number more than 24 causes thermal decomposition of the resultant finish and subsequent finish buildup on draw roll surface in thermal drawing to increase broken filament and ends down.

In the chemical formula (2), p and q are independently an integer ranging from 1 to 4, and should preferably be 2. The ester of the chemical formula (2) having p and q beyond the range from 1 to 4 is not effective to prevent oxidization of the finish, and causes thermal decomposition of the resultant finish and subsequent finish buildup on draw roll surface in thermal drawing to increase broken filament and ends down.

Examples of the linear hydrocarbon group include, for example, n-dodecyl group, n-tridecyl group, n-tetradecyl group, n-pentadecyl group, n-hexadecyl group, oleyl group and stearyl group. Examples of the branched hydrocarbon group include, for example, isododecyl group, isotridecyl group, isotetradecyl group, isopentadecyl group, isohexadecyl group, 2-hexyldecyl group and isostearyl group. Of those hydrocarbon groups, isohexadecyl group, oleyl group and isostearyl group are preferable for optimizing the lubricity of the resultant finish.

A monocarboxylic acid represented by the following chemical formula (3) is preferable for the monocarboxylic acid having a thioether group and constituting the compound having a structure formed by the esterification of the thioether monocarboxylic acid and a polyhydric alcohol, in order to exert the effect of the present invention.

[Chem. 3]

$$R^5SR^6COOH \quad (3)$$

where $R^5$ represents an aliphatic group or aromatic group, especially a saturated or unsaturated $C_8$-$C_{20}$ alkyl group which may have a branched chain; and $R^6$ represents a hydrocarbon group including aliphatic or aromatic groups, preferably a $C_1$-$C_6$ alkylene group which may have side chain.

The polyhydric alcohol constituting the compound having a structure formed by the esterification of a thioether monocarboxylic acid and a polyhydric alcohol is not specifically restricted, and examples thereof include ethylene glycol, propylene glycol, hexylene glycol, glycerin, pentaerythritol, trimethylol propane and sorbitol. The ester may also be formed by the esterification of the thioether monocarboxylic acid and a higher monohydric alcohol, such as lauryl alcohol, tridecyl alcohol, stearyl alcohol, oleyl alcohol and isostearyl alcohol. The preferable alcohols for the esterification are polyhydric alcohols, such as glycerin, pentaerythritol and trimethylol propane.

Examples of the sulfur-containing ester (A3) include, for example, di-linear esters of thiodiethanoic acid, such as di-n-dodecyl thiodiethanoate, di-n-tridecyl thiodiethanoate, di-n-tetradecyl thiodiethanoate, di-n-pentadecyl thiodiethanoate, di-n-hexadecyl thiodiethanoate and di-oleyl thiodiethanoate; di-branched esters of thiodiethanoic acid, such as di-isododecyl thiodiethanoate, di-isotridecyl thiodiethanoate, di-isotetradecyl thiodiethanoate, di-isopentadecyl thiodiethanoate, di-isohexadecyl thiodiethanoate, di-2-hexyldecyl thiodiethanoate and di-isostearyl thiodiethanoate; di-linear esters of thiodipropionic acid, such as di-n-dodecyl thiodipropionate, di-n-tridecyl thiodipropionate, di-n-tetradecyl thiodipropionate, di-n-pentadecyl thiodipropionate, di-n-hexadecyl thiodipropionate and di-oleyl thiodipropionate; di-branched esters of thiodipropioic acid, such as di-isododecyl thiodipropionate, di-isotridecyl thiodipropionate, di-isotetradecyl thiodipropionate, di-isopentadecyl thiodipropionate, di-isohexadecyl thiodipropionate, di-2-hexyldecyl thiodipropionate and di-isostearyl thiodipropionate; di-linear esters of thiodibutanoic acid, such as di-n-dodecyl thiodibutanoate, di-n-tridecyl thiodibutanoate, di-n-tetradecyl thiodibutanoate, di-n-pentadecyl thiodibutanoate, di-n-hexadecyl thiodibutanoate and di-oleyl thiodibutanoate; di-branched esters of thiodibutanoic acid, such as di-isododecyl thiodibutanoate, di-isotridecyl thiodibutanoate, di-isotetradecyl thiodibutanoate, di-isopentadecyl thiodibutanoate, di-isohexadecyl thiodibutanoate, di-2-hexyldecyl thiodibutanoate and di-isostearyl thiodibutanoate; di-linear esters of thiodipentanoic acid, such as di-n-dodecyl thiodipentanoate, di-n-tridecyl thiodipentanoate, di-n-tetradecyl thiodipentanoate, di-n-pentadecyl thiodipentanoate, di-n-hexadecyl thiodipentanoate and di-oleyl thiodipentanoate; di-branched esters of thiodipentanoic acid, such as di-isododecyl thiodipentanoate, di-isotridecyl thiodipentanoate, di-isotetradecyl thiodipentanoate, di-isopentadecyl thiodipentanoate, di-isohexadecyl thiodipentanoate, di-2-hexyldecyl thiodipentanoate and di-isostearyl thiodipentanoate; and esters of a thioether and monocarboxylic acid, such as hexanediol dioctadecyl thiopropionate, trimethylolpropane tridodecyl thiopropionate, glycerin tridodecyl thiopropionate and pentaerythritol tetraoctadecyl thiopropionate.

Of those esters, di-linear esters and di-branched esters of thiodipropionic acid are preferable, and di-isohexadecyl thiodipropionate, di-oleyl thiodipropionate and di-isostearyl thiodipropionate are more preferable to achieve sufficient finish film strength and lubricity of filament strands imparted by the resultant finish.

One of or a combination of at least two of those sulfur-containing esters (A3) may be used.

The iodine value of the sulfur-containing ester (A3) is not specifically restricted. The iodine value mentioned herein is determined according to the method of JIS K-0070.

The process for preparing the sulfur-containing ester (A3) is not specifically restricted, and any of known processes may be employed. For example, the ester may be prepared by esterification reaction of thiodipropionic acid with an aliphatic alcohol. Specifically, the ester may be prepared by charging a thiodipropionic acid and an aliphatic alcohol in a mole ratio from 1:2 to 1:2.5 and esterifying the compounds along with removal of water generated in the reaction.

The temperature for the esterification usually ranges from 120° C. to 250° C. and preferably from 130° C. to 230° C. The period for the esterification usually ranges from 1 hour to 10 hours and preferably from 2 hours to 8 hours. The esterification may be carried out without a catalyst or in the presence of an esterification catalyst mentioned later.

Examples of the aliphatic alcohol include, for example, n-dodecanol, n-tridecanol, n-tetradecanol, n-pentadecanol, n-hexadecanol, isododecanol, isotridecanol, isotetradecanol, isopentadecanol, isohexadecanol, 2-hexyldecanol, oleyl alcohol and stearyl alcohol. Of those alcohols, isohexadecanol, oleyl alcohol and isostearyl alcohol are preferable.

One of or a combination of at least two of those aliphatic alcohols may be used.

Examples of the esterification catalyst include Lewis acids and sulfonic acids. Specifically, examples of the Lewis acids include aluminum derivatives, tin derivatives and titanium derivatives, and examples of the sulfonic acids include p-toluenesulfonic acid, methanesulfonic acid and sulfuric acid. Of those catalysts, titanium derivatives and sulfonic acids are preferable. The amount of the catalysts used in the esterification preferably ranges from 0.05 to 5 wt % of the total of the ingredients for the esterification.

The water generated in the esterification may be removed from the reaction system, if necessary, through codistillation with a water entrainer such as benzene, toluene, xylene and cyclohexane.

After the esterification, excess of the aliphatic alcohol is removed by distillation under reduced or normal pressure, and the reaction product is refined in a conventional process, such as washing with water, vacuum distillation or refining with an activated carbon adsorbent, to obtain a di-ester of thiodipropionic acid.

Polyhydric alcohol fatty acid ester having at least one hydroxyl group per molecule (B)

The synthetic fiber finish of the present invention essentially contains a polyhydric alcohol fatty acid ester having at least one hydroxyl group per molecule (B).

The polyhydric alcohol fatty acid ester having at least one hydroxyl group per molecule (B) is an ester having a structure formed by the esterification of an alcohol having at least three hydroxyl groups and a fatty acid.

The number of the ester bond per molecule of the ester (B) is lower than the number of the hydroxyl groups per molecule of the polyhydric alcohol constituting the ester (B), and should preferably be one or two.

The ester (B) containing hydroxyl groups functions to improve the solubility of the lubricant (A) containing no hydroxyl groups when the ester (B) is combined with the lubricant (A), thereby facilitates the removal of the lubricant (A) from fiber in washing with water.

The polyhydric alcohol constituting the ester (B) should have at least three hydroxyl groups, more preferably three or four hydroxyl groups, and further more preferably three hydroxyl groups per molecule.

Examples of the polyhydric alcohol constituting the ester (B) include, for example, glycerin, trimethylol propane, pentaerythritol, erythritol, diglycerin, triglycerin, sorbitan, sorbitol, ditrimethylol propane, dipentaerythritol, triglycerin, tetraglycerin and sucrose. Of those polyhydric alcohols, glycerin, trimethylol propane, pentaerythritol, erythritol, diglycerin, triglycerin, sorbitan, sorbitol, ditrimethylol propane, dipentaerythritol, and sucrose are preferable, and diglycerin and triglycerin are more preferable for their good compatibility with the lubricant (A) and compatibility with water to contribute to good adhesion of silicone resins to the fabric of the fiber produced with the resultant finish. In other words, the polyhydric alcohol constituting the ester (B) should preferably include at least one selected from diglycerin and triglycerin.

The fatty acid constituting the ester (B) may be either saturated or unsaturated. The number of unsaturated bonds contained in the fatty acid is not specifically restricted, and should preferably be one or two because a fatty acid containing three or more unsaturated bonds results in increased viscosity of the resultant fiber finish due to the oxidation and degradation of the ester (B) to deteriorate the lubricity imparted by the finish. The carbon number of the fatty acid should preferably range from 8 to 24, more preferably from 10 to 20, and further more preferably from 12 to 18 to simultaneously achieve sufficient finish film strength and lubricity of filament strands imparted by the resultant finish. One of or a combination of at least two of the fatty acids may be employed, and a combination of saturated and unsaturated fatty acids may also be employed.

The ester (B) is not specifically restricted and examples thereof include trimethylolpropane dicaprylate, trimethylolpropane dicaprinate, trimethylolpropane dilaurate, trimethylolpropane dioleate, trimethylolpropane laurate myristylate, trimethylolpropane laurate oleate, trimethylolpropane myristylate oleate, trimethylolpropane di-palm-kernel-fatty-acid ester, trimethylolpropane di-coco-fatty-acid ester, glycerin dioleate, glycerin monolaurate, diglycerin dioleate, diglycerin dilaurate, diglycerin triolerate, triglycerin dioleate, sorbitan dilaurate, sorbitan monooleate, erythritol trioleate and erythritol dipalmitate. Of those esters, diglycerin dioleate, triglycerin dioleate and sorbitan monooleate are preferable for their good compatibility with the lubricant (A) and compatibility with water to contribute to good adhesion of silicone resins to the fabric of the fiber produced with the resultant finish.

Organic Sulfonic Acid Compound (C)

The organic sulfonic acid compound (C) is an essential component of the finish of the present invention. The compound improves the heat resistance of the finish to decrease the broken filament of the finish-applied filament strand and also improves the removability of the resultant finish from fabric in scouring so as to improve the adhesion of silicone resins to the resultant fabric.

The nonvolatile component of the finish containing the lubricant (A), polyhydric alcohol fatty acid ester having at least one hydroxyl group per molecule (B) and organic sulfonic acid compound (C) should preferably contain sulfate ion ($SO_4^{2-}$) and chlorine ion ($Cl^-$) respectively in an amount of not higher than 300 ppm detected by ion chromatography, in order to drastically decrease broken filament, ends down and stain on rolls. The sulfate ion ($SO_4^{2-}$) and chlorine ion ($Cl^-$) may be simply referred to as sulfate ion and chlorine ion, respectively.

The organic sulfonic acid compound (C) represented by the following chemical formula (4) is preferable for exerting the effect of the present invention.

[Chem. 4]

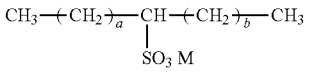

(4)

where each of a and b represents an integer of at least 0 and meets the equation a+b=5 to 17; and M represents hydrogen atom, alkaline metal, ammonium group or organic amine group.

In the chemical formula (4), each of a and b represents an integer of at least 0 and meets the equation, a+b=5 to 17. If the sum of a and b is lower than 5, the resultant organic sulfonic acid compound (C) has poor performance to decrease stain on rolls. On the other hand, if the sum of a and b is higher than 17, the resultant organic sulfonic acid compound (C) has high melting point and poor compatibility with other finish components and cannot be blended in the finish. The sum of a and b should preferably range from 7 to 17, and more preferably from 10 to 15.

M represents hydrogen atom, alkali metal, ammonium group or organic amine group. Examples of the alkali metal include, for example, lithium, sodium and potassium. Examples of the ammonium group or organic amine group include a group represented by $NR^aR^bR^cR^d$. Each of $R^a$, $R^b$, $R^c$ and $R^d$ is independently a hydrogen atom, alkyl group, alkenyl group, or polyoxyalkylene group. The alkyl group and alkenyl group should preferably have a carbon number ranging from 1 to 24, more preferably from 1 to 20, and further more preferably from 1 to 18. The polyoxyalkylene group is represented by $-(A^1O)_mH$. $A^1O$ represents a $C_2$-$C_4$ oxyalkylene group. The m representing the number of the repeating oxyalkylene units is an integer ranging from 0 to 15, preferably from 0 to 10, more preferably from 0 to 3 and most preferably be 0 which is the case of not containing polyoxyalkylene groups. The $(A^1O)_m$ should preferably be an polyoxyalkylene group containing at least 50 mol % of oxyethylene unit as the oxyalkylene unit.

Examples of the group represented by $NR^aR^bR^cR^d$ includes, for example, ammonium group, methylammonium group, ethylammonium group, propylammonium group, butylammonium group, hexylammonium group, octylammonium group, dimethylammonium group, diethylammonium group, dipropylammonium group, dibutylammonium group, dihexylammonium group, dioctylammonium group, trimethylammonium group, triethylammonium group, tripropylammonium group, tributylammonium group, trihexylammonium group, trioctylammonium group, tetramethylammonium group, tetraethylammonium group, tetrapropylammonium group, tetrabutylammonium group, tetrahexylammonium group, tetraoctylammonium group, ethyltrimethylammonium group, propyltrimethylammonium group, butyltrimethylammonium group, hexyltrimethylammonium group, octyltrimethylammonium group, methanolammonium group, ethanolammonium group, propanolammonium group, butanolammonium group, hexanolammonium group, octanolammonium group, dimethanolammonium group, diethanolammonium group, dipropanolammonium group, dibutanolammonium group, dihexanolammonium group, dioctanolammonium group, trimethanolammonium group, triethanolammonium group, tripropanolammonium group, tributanolammonium group, trihexanolammonium group, trioctanolammonium group, EO (6) butylaminoether group, EO (6) hexylaminoether group, EO (6) octylaminoether group, EO (6) decylaminoether group, EO (6) laurylaminoether group, EO (6) tetradecylaminoether group, EO (6) hexadecylaminoether group, EO (6) oleylaminoether group, EO (6) stearylaminoether group, EO (6) gadoleylaminoether group, EO (6) tetracosylaminoether group, EO (10) oleylaminoether group, EO (10) oleylaminoether-erucic acid salt, EO (3) laurylaminoether group, EO (7) laurylaminoether group, EO (15) oleylaminoether group, EO (5)/PO (3) stearylaminoether group and EO (3)/PO (5) stearylaminoether group. PO represents oxypropylene and EO represents oxyethylene. PO (3) represents 3 moles of oxypropylene and EO (5)/PO (3) represents randomly polymerized 5 moles of oxyethylene and 3 moles of oxypropylene.

The finish component (hereinafter referred to as Component X) containing the organic sulfonic acid compound (C) contains sodium sulfate and/or sodium chloride due to the production process of the component. The ratio of the sodium sulfate and sodium chloride in Component X can be calculated from the ratio by weight of the sulfate ion and chlorine ion detected in the Component X by ion chromatography.

The amount of the sulfate ion detected in Component X containing sodium sulfate is generally at least 20,000 ppm of the organic sulfonic acid compound (C). The amount of the chlorine ion detected in Component X containing sodium chloride is generally at least 20,000 ppm of the organic sulfonic acid compound (C).

The finish containing such Component X may leave the sodium sulfate and sodium chloride on draw roll surface in fiber production which accumulates on roll surface and increases ends down. The sodium sulfate and sodium chloride accelerate finish buildup on hot draw rolls that results in stain on the draw rolls. Examples of the Component X causing such problems include HOSTAPUR SAS (produced by Hoechst) and Mersolat H (produced by Bayer).

In order to exert the effect of the present invention, the finish of the present invention should preferably contain a finish component (hereinafter referred to as Component Y) which contains the organic sulfonic acid compound (C) prepared by decreasing the sodium sulfate and sodium chloride in Component X. Specifically, the amount of each of the sulfate ion and chlorine ion detected in Component Y by ion chromatography should preferably be 5000 ppm or less of the organic sulfonic acid compound (C).

The amount of the sulfate ion detected in Component Y should preferably be not higher than 4000 ppm of the organic sulfonic acid compound (C), more preferably not higher than 3000 ppm and most preferably not higher than 2000 ppm in order to better exert the effect of the present invention. Similarly the amount of the chlorine ion detected in Component Y should preferably be not higher than 4000 ppm of the organic sulfonic acid compound (C), more preferably not higher than 3000 ppm and most preferably not higher than 2000 ppm.

The amounts of the sulfate ion and chlorine ion mentioned herein were detected by ion chromatography according to the procedure described in Example.

The process for decreasing the sodium sulfate and sodium chloride in Component X containing the organic sulfonic acid compound (C) is not specifically restricted, and the substances can be decreased by a known process. For example, the sodium sulfate in Component X can be decreased by adding a solvent such as methanol or water to precipitate and separate the inorganic substances such as sodium sulfate. The sodium chloride in Component X can be decreased by filtering out the sodium chloride through ion-exchange membrane or making the sodium chloride absorbed by ion-exchange resin.

The organic sulfonic acid compound (C) is a monosulfonic acid compound having one sulfo group per molecule. The finish of the present invention may contain a disulfonic acid compound of the chemical formula (5) in addition to the monosulfonic acid compound.

[Chem. 5]

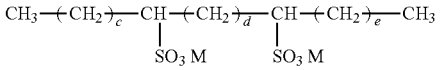

(5)

In the chemical formula (5), c, d and e are integers of at least 0 and meet the equation, c+d+e=4 to 16. If the sum of c, d and e is lower than 4, the disulfonic acid compound may have insufficient effect to decrease stain on rolls. On the other hand, if the sum of c, d and e is higher than 17, the disulfonic acid may have poor compatibility with other components of the finish and may not be blended in the finish. The sum of c, d and e should preferably range from 6 to 16, and more preferably from 9 to 14.

M is a hydrogen atom, alkali metal, ammonium group or organic amine group. M is the same as the M mentioned in the description of the chemical formula (4).

If the finish of the present invention contains the disulfonic acid compound, the ratio by weight of the monosulfonic acid compound, which is the organic sulfonic acid compound (C), and the disulfonic acid of the chemical formula (5) should preferably range from 50:50 to 99:1, more preferably from 70:30 to 99:1, and further more preferably from 80:20 to 98:2.

Alkyl Polyether (D)

The alkyl polyether (D) for the finish of the present invention is a compound formed by the addition polymerization of alkylene oxide with a monohydric alcohol wherein the alkylene oxide (AO) essentially contains propylene oxide (PO) in an amount of at least 20 wt % of the total of the alkylene oxide, and the weight average molecular weight of the alkyl polyether ranges from 500 to 20000.

The synthetic fiber finish of the present invention should preferably contain the alkyl polyether (D) for improving the removability of the synthetic fiber finish from fabric in scouring so as to improve the adhesion of silicone resins to the fabric manufactured of the fiber produced with the finish.

Examples of the monohydric alcohol include aliphatic monohydric alcohols and alicyclic monohydric alcohols, and aliphatic monohydric alcohols are preferable for the cost, reactivity and the performance of the resultant finish.

The monohydric alcohol should preferably be a primary or secondary alcohol, and a primary alcohol is more preferable. The residual hydrocarbon group after removing a hydroxyl group from the monohydric alcohol may be linear or branched and saturated or unsaturated. The carbon number of the monohydric alcohol should preferably range from 8 to 24, more preferably from 10 to 22 and further more preferably from 12 to 18 for attaining optimum finish performance.

Examples of the monohydric alcohol include, for example, saturated aliphatic alcohols, such as octyl alcohol, nonyl alcohol, decyl alcohol, undecyl alcohol, dodecyl alcohol, tridecyl alcohol, tetradecyl alcohol, cetyl alcohol, stearyl alcohol and nonadecyl alcohol; unsaturated aliphatic alcohols, such as octenyl alcohol, decenyl alcohol, dodecenyl alcohol, tridecenyl alcohol, pentadecenyl alcohol, oleyl alcohol, gadoleyl alcohol and linoleyl alcohol; and alicyclic alcohols, such as ethylcyclohexyl alcohol, propylcyclohexyl alcohol, octylcyclohexyl alcohol, nonylcyclohexyl alcohol and adamantly alcohol.

Of those alcohols, octyl alcohol, nonyl alcohol, decyl alcohol, dodecyl alcohol, tridecyl alcohol, tetradecyl alcohol, cetyl alcohol, stearyl alcohol, nonadecyl alcohol and oleyl alcohol are preferable, and dodecyl alcohol, tridecyl alcohol, tetradecyl alcohol, cetyl alcohol, stearyl alcohol and oleyl alcohol are more preferable.

Examples of the alkylene oxide (AO) include ethylene oxide (EO), propylene oxide (PO), butylene oxide (BO), and the like. The alkyl polyether containing alkylene oxides (AO) except propylene oxide (PO) may contain either a random copolymer or brock copolymer of alkylene oxides, and the alkyl polyether containing the random copolymer is preferable for the production efficiency.

Of those alkyl polyethers (D), an alkyl polyether formed by the addition polymerization of propylene oxide (PO) or both ethylene oxide (EO) and propylene oxide (PO) with a monohydric alcohol is preferable for sufficiently exerting the effect of the present invention, and the ratio by weight of the added EO and PO should preferably range from 80:20 to 20:80. The weight average molecular weight of the alkyl polyether should preferably range from 500 to 20000.

The ratio by weight of the added EO and PO should more preferably range from 70:30 to 30:70 and further more preferably from 60:40 to 40:60.

The weight average molecular weight of the alkyl polyether (D) should preferably range from 5000 to 20000, more preferably from 1000 to 10000, further more preferably from 1500 to 7000 and most preferably from 1500 to 3000. The alkyl polyether (D) having a weight average molecular weight lower than 500 may cause poor heat resistance of the resultant finish. On the other hand, the alkyl polyether (D) having a weight average molecular weight higher than 20000 may increase dynamic friction of the synthetic filament strand applied with the resultant finish to cause broken filament and ends down. In addition, the viscosity of the resultant finish will be increased to cause difficulty in handling the finish. The weight average molecular weight of the alkyl polyether (D) was determined in the same manner as that for the lubricant (A) mentioned above.

The weight average molecular weight mentioned in the present invention was calculated from the peaks measured with a refractive index detector and a high-speed gel permeation chromatography device (HCL-8220GPC, manufactured by Tosoh Corporation) in which a solution containing a sample in an amount of 3 mg/ml was charged in chromatography columns, KF-402HQ and KF-403HQ (manufactured by Showa Denko K.K.).

Ether Ester (E)

The ether ester (E) for the finish of the present invention is a compound having a structure formed by the esterification of a monohydric fatty acid and a monohydric alcohol bonded with alkylene oxide (AO) essentially containing ethylene oxide (EO) through addition polymerization.

The ether ester (E) should preferably be blended in the synthetic fiber finish of the present invention, because the ester (E) improves the removability of the finish from fabric in scouring and thus contributes to better adhesion of silicone resins to the fabric manufactured of the fiber produced with the finish.

The ether ester (E) is not specifically restricted, and examples thereof include, for example, POE (3) $C_{12}$-$C_{13}$ alkyl decanoate, EO/PO (75:25) $C_{12}$-$C_{13}$ alkyl laurate, and EO/PO (75:25) decyl octanoate.

Polyoxyalkylene Polyhydric Alcohol Fatty Acid Ester (F)

The finish of the present invention should preferably contain the polyoxyalkylene polyhydric alcohol fatty acid ester (F) for improving the compatibility of the resultant synthetic fiber finish to water so as to improve the removability of the finish from fabric in scouring and thus improve the adhesiveness of silicone resins to the fabric manufactured of the fiber produced with the finish.

The polyoxyalkylene polyhydric alcohol fatty acid ester (F) is not specifically restricted, and examples thereof include ethoxylated hydrogenated castor oil, ethoxylated castor oil, ethoxylated hydrogenated castor oil monooleate, ethoxylated hydrogenated castor oil dioleate, ethoxylated hydrogenated castor oil trioleate, ethoxylated castor oil trioleate, ethoxylated hydrogenated castor oil tristearate, and ethoxylated castor oil tristearate. Of those esters, ethoxylated hydrogenated castor oil, ethoxylated hydrogenated castor oil trioleate and ethoxylated hydrogenated castor oil tristearate are preferable for achieving good finish compatibility, strong finish film and decreased broken filament. In addition, ethoxylated glycerin monolaurate, ethoxylated glycerin dilaurate, ethoxylated glycerin trilaurate, ethoxylated trimethylol propane trilaurate, ethoxylated sorbitan monooleate, ethoxylated sorbitan dioleate, ethoxylated sorbitan trioleate, ethoxylated propoxylated sorbitan monooleate, ethoxylated propoxylated sorbitan dioleate, ethoxylated propoxylated sorbitan trioleate, ethoxylated propoxylated sorbitan trilaurate and ethoxylated sucrose trilaurate are preferable.

The polyoxyalkylene polyhydric alcohol fatty acid ester (F) is not specifically restricted, and examples thereof include the condensation product of POE (25) hydrogenated castor oil ether with maleic acid and stearic acid, POE (25) hydrogenated castor oil triisostearate, POE (25) hydrogenated castor oil ether trioleate, POE (20) hydrogenated castor oil ether, and POE (20) glycerin trioleate.

Synthetic Fiber Finish

The synthetic fiber finish containing the lubricant (A), the ester (B) and the sulfur-containing ester (A3) in a specific weight ratio mentioned below keeps good compatibility between the components to solve the problems mentioned herein, which are high heat resistance of the finish and good adhesion of silicone resins to the fabric manufactured of the fiber produced with the finish.

The amount of the lubricant (A) in the nonvolatile component of the finish should preferably range from 50 to 90 wt %, more preferably from 51 to 85 wt %, further more preferably from 53 to 80 wt %, and yet further more preferably from 55 to 75 wt %. An amount of the lubricant lower than 50 wt % may deteriorate the lubricity of the finish to increase broken filament, while an amount of the lubricant higher than 90 wt % may cause poor fiber cohesion or poor emulsification of the finish to make the finish emulsion unstable and unapplicable in fiber production. The nonvolatile component mentioned herein means the bone dry matter obtained by heating and drying the finish at 105° C. to remove solvents or volatile components to a constant weight.

The amount of the ester (B) in the nonvolatile component of the finish should preferably range from 1 to 20 wt %, more preferably from 2 to 18 wt %, further more preferably from 4 to 16 wt %, and yet further more preferably from 5 to 15 wt %. An amount of the ester lower than 1 wt % may deteriorate the compatibility of the lubricant (A) with the sulfur-containing ester (A3) to disturb the removal of the finish from fabric in scouring to diminish the effect of the present invention. On the other hand, an amount of the ester higher than 20 wt % may deteriorate the lubricity of the finish to increase broken filament.

The amount of the sulfur-containing ester (A3) in the nonvolatile component of the finish should preferably range from 5 to 20 wt %, more preferably from 7 to 18 wt %, further more preferably from 8 to 16 wt %, and yet further more preferably from 10 to 15 wt %. An amount of the sulfur-containing ester lower than 5 wt % may cause poor heat resistance of the resultant finish. On the other hand, an amount of the sulfur-containing ester higher than 20 wt % may deteriorate the compatibility of the ester with the organic sulfonic acid compound (C) to diminish the effect of the present invention.

The amount of the total sulfuric acid in the nonvolatile component of the finish should preferably range from 0.1 to 3 wt %, more preferably from 0.3 to 2.8 wt % and further more preferably from 0.5 to 2.5 wt % for formulating the finish having high heat resistance and being easily removed from fabric in scouring. An amount of the total sulfuric acid lower than 0.1 wt % may diminish the effect of the present invention, because the low amount indicates that the sulfur-containing ester (A3) and organic sulfonic acid compound (C) are not sufficiently contained in the finish. On the other hand, an amount of the total sulfuric acid higher than 3 wt % may also diminish the effect of the present invention, because the high amount implies that the sulfur-containing ester (A3) and organic sulfonic acid compound (C) are contained excessively and cause poor compatibility of the components with the lubricant (A). The amount of the total sulfuric acid in the nonvolatile component of the finish of the present invention is determined by the method described in Example herein.

The finish should preferably contain sulfate ($SO_4^{2-}$) ion and chlorine ion ($Cl^-$) each in an amount of not higher than 300 ppm, which are detected in the nonvolatile component of the finish by ion chromatography. The controlled amount of sulfate and chlorine ions detected in the nonvolatile component of the finish is effective to drastically decrease broken filament, ends down and stain on rolls and contributes to good removability of the resultant finish from fabric in scouring.

If the amount of the sulfate ion or chlorine ion exceeds 300 ppm of the nonvolatile component of the finish, sodium sulfate or sodium chloride may be left and accumulated on draw rolls in fiber production to increase ends down or accelerate finish buildup on hot draw rolls that results in stain on the draw rolls.

In the present invention, the sulfate ion and chlorine ion were detected by ion chromatography according to the process described in Example.

The amount of the sulfate ion should preferably be not higher than 250 ppm of the nonvolatile component, more preferably not higher than 200 ppm and most preferably not higher than 100 ppm in order to exert the effect of the present invention. Similarly the amount of the chlorine ion should preferably be not higher than 250 ppm of the nonvolatile component, more preferably not higher than 200 ppm and most preferably not higher than 100 ppm.

The amount of the sulfate ion and chlorine ion is controlled by decreasing the amount of sodium sulfate and sodium chloride in Component X containing the organic sulfonic acid compound (C).

The amount of the organic sulfonic acid compound (C) in the nonvolatile component of the finish should preferably range from 0.5 to 12 wt %, more preferably from 0.5 to 10 wt %, and most preferably from 0.5 to 8 wt %. The amount lower than 0.5 wt % may fail to decrease stain on rolls and lead to insufficient removal of the resultant finish from fabric in scouring. On the other hand, the amount higher than 12 wt % may result in high friction on filament strands to increase broken filament.

The amount of the alkyl polyether (D) in the nonvolatile component of the finish should preferably range from 10 to 30 wt %, more preferably from 13 to 27 wt %, and most preferably from 15 to 25 wt %, when the finish further contains the alkyl polyether (D). The amount lower than 10 wt % may fail to make the finish readily removable from fabric in scouring. On the other hand, the amount higher than 30 wt % may deteriorate the heat resistance of the resultant finish.

The amount of the ether ester (E) in the nonvolatile component of the finish should preferably range from 1 to 30 wt %, more preferably from 2 to 30 wt %, further more preferably from 3 to 30 wt %, yet further more preferably from 10 to 30 wt %, still further more preferably from 13 to 27 wt %, and most preferably from 15 to 25 wt %, when the finish further contains the ether ester (E). The amount lower than 1 wt % may fail to make the finish readily removable from fabric in scouring. On the other hand, the amount higher than 30 wt % may deteriorate the heat resistance of the resultant finish.

The amount of the polyoxyalkylene polyhydric alcohol fatty acid ester (F) in the nonvolatile component of the finish should preferably range from 2 to 30 wt %, more preferably from 3 to 27 wt %, and most preferably from 5 to 25 wt %, when the finish further contains the polyoxyalkylene polyhydric alcohol fatty acid ester (F). The amount lower than 2 wt % may fail to make the finish easily removable from fabric in scouring. On the other hand, the amount higher than 30 wt % may deteriorate the lubricity and heat resistance of the resultant finish.

Other Components

The synthetic fiber finish of the present invention may contain a surfactant other than the organic sulfonic acid compound (C), alkyl polyether (D), ether ester (E) and polyoxyalkylene polyhydric alcohol fatty acid ester (F) in order to emulsify the finish, facilitate the finish adsorption on fiber and impart antistaticity, lubricity and cohesiveness to filament strands. The surfactant includes anionic surfactants, such as alkyl phosphate salts and fatty acid soaps; cationic surfactants, such as alkylamine salts, alkylimidazolinium salts and quaternary ammonium salts; amphoteric surfactants, such as lauryldimetyl betaine and stearyldimethyl betaine; and nonionic surfactants, such as dimethyllaurylamine oxide, polyoxyalkylene aminoether, and polyoxyalkylene alkylphenyl ether (except the alkyl polyether (D), ether ester (E) and polyoxyalkylene polyhydric alcohol fatty acid ester (F)). One of or a combination of at least two of the surfactants may be used. The amount of the surfactant in the nonvolatile component of the finish is not specifically restricted, and should preferably range from 0.01 to 15 wt %, and more preferably from 0.1 to 10 wt %. The surfactants mentioned here have a weight average molecular weight lower than 1000.

The synthetic fiber finish of the present invention may also contain an antioxidant to improve the heat resistance of the resultant finish. The antioxidant includes known antioxidants, such as phenol-based, thio-based, or phosphite-based antioxidants. One of or a combination of at least two of those antioxidants may be used. The amount of the antioxidant in the nonvolatile component of the finish is not specifically restricted, and should preferably range from 0.1 to 5 wt % and more preferably from 0.1 to 3 wt %.

The synthetic fiber finish of the present invention may also contain a neat-finish stabilizer including water, ethylene glycol and propylene glycol. The amount of the stabilizer in the finish should preferably range from 0.1 to 30 wt % and more preferably from 0.5 to 20 wt %.

The synthetic fiber finish of the present invention may take any forms, such as a finish composition composed only of the nonvolatile component mentioned above, a mixture of the nonvolatile component and a neat-finish stabilizer, a dilution of the nonvolatile component in a low-viscosity mineral oil, or an aqueous emulsion of the nonvolatile component in water. The amount of the nonvolatile component in the synthetic fiber finish of the present invention in the form of an aqueous emulsion of the nonvolatile component should preferably range from 5 to 35 wt % and more preferably from 6 to 30 wt %. The viscosity at 30° C. of the finish in the form of dilution of the nonvolatile component in a low-viscosity mineral oil should preferably range from 3 to 120 $mm^2/s$ and more preferably from 5 to 100 $mm^2/s$ in order to uniformly apply the finish on fiber.

The process for formulating the synthetic fiber finish is not specifically restricted, and any known processes may be employed. The synthetic fiber finish may be formulated by blending the components mentioned above in a specific or optional order. Each component may be refined by removing catalysts and the like before formulating the finish for the purpose of improving the heat resistance of the resultant finish. In particular, the lubricant (A), polyhydric alcohol fatty acid ester having at least one hydroxyl group per molecule (B), alkyl polyether (D), ether ester (E) and polyoxyalkylene polyhydric alcohol fatty acid ester (F) used for the finish formulation sometimes contain inorganic substances, which should preferably be removed by refining those components if the inorganic substances may remarkably deteriorate the effect of the present invention. The components may be refined by removing the inorganic substances in known processes, for example, the lubricant (A) and ether ester (E) can be refined by filtration through diatomaceous earth, and the polyhydric alcohol fatty acid ester having at least one hydroxyl group per molecule (B), alkyl polyether (D) and polyoxyalkylene polyhydric alcohol fatty acid ester (F) can be refined by absorbing their inorganic substances with an inorganic synthetic absorbent.

Process for Producing Synthetic Filament Strands, and Textile Products

The process for producing the synthetic filament strands of the present invention includes the step of applying the synthetic fiber finish of the present invention to a base synthetic filament strand. The process of the present invention decreases the snow deposit and ends down in spinning and drawing to produce high-quality synthetic filament strands. The base synthetic filament strand of the present invention means a synthetic filament strand which is not applied with a finish.

The process for applying the synthetic fiber finish to a synthetic filament strand is not specifically restricted, and the synthetic fiber finish may be applied to a synthetic filament strand by any of known processes. Usually, the synthetic fiber finish is applied to base filament strands in spinning process, and after the finish application the filament strand is drawn and heat-set on heater rolls and taken up. The synthetic fiber finish of the present invention is preferably applied to synthetic filament strands which are directly fed to thermal drawing step without take-up after finish application. The heating temperature in the drawing step for polyester and nylon filament strands, for example, ranges from 210 to 260° C.

The synthetic fiber finish is applied to a base synthetic filament strand in various forms as mentioned above including a neat finish composed only of the nonvolatile component, a dilution of the nonvolatile component in a low-viscosity mineral oil or an aqueous emulsion of the nonvolatile component. The finish application method is not specifically restricted, and examples thereof include metering-guide application, kiss roll application, dipping and spraying. Of those methods, metering-guide application and kiss roll application are preferable for easy adjustment of the amount of finish on filament strands.

The amount of the nonvolatile component of the synthetic fiber finish applied to filament strand should preferably range from 0.05 to 5 wt % of the base synthetic filament strand, more preferably from 0.1 to 3 wt %, and further more preferably from 0.1 to 2 wt %. The amount of the nonvolatile component lower than 0.05 wt % may not exert the effect of the present invention. On the other hand, the amount of the nonvolatile component higher than 5 wt % may be apt to cause the accumulation of the nonvolatile component of the finish on the pass of the filament strands and increase finish buildup on heater rolls to result in broken filament and ends down.

Examples of the base synthetic filament strands include polyester, polyamide and polyolefin filament strands. The synthetic fiber finish of the present invention is suitable for the filament strands of polyester, polyamide and polyolefin. Examples of the polyester filament include the filaments of the polyester composed of ethylene terephthalate monomers (PET), the polyester composed of trimethylene ethylene terephthalate monomers (PTT), the polyester composed of butylene ethylene terephthalate monomers (PBT) and the polyester composed of lactic acid monomers (PLA). Examples of the polyamide filament include the filaments of nylon 6 and nylon 66. Examples of the polyolefin filaments include the filaments of polypropylene and polyethylene. Of those synthetic filaments, polyamide filament is preferable for the filament strand produced with the finish of the present invention, because the filament meets the requirements of high heat resistance and good adhesion of silicone resins to the fabric manufactured of the filament, which are the subject of the present invention. The process for producing the synthetic filament strands is not specifically restricted, and any known processes may be employed.

Textile Product

The textile product of the present invention contains the synthetic filament strands produced in the process of the present invention mentioned above. Specifically, the textile product include fabrics manufactured of the synthetic filament strands applied with the synthetic fiber finish of the present invention, such as woven fabrics manufactured by water-jet looms, air-jet looms or rapier looms and knit fabrics manufactured by circular knitting machines, warp knitting machines and weft knitting machines. The end uses of the textile product include tire cord fabric, seat belts, airbags, fish net and rope. Of those end uses, airbags is preferable, because the textile product meets the requirement to airbags, such as high heat resistance and good adhesion of silicone resins to the textile product, which are the subject of the present invention. The processes for manufacturing the woven and knit fabrics are not specifically restricted, and any known processes may be employed.

EXAMPLE

The present invention is further illustrated with the examples of embodiments mentioned below, though the present invention is not restricted within the scope of the embodiments herein. The parts and % in the following description and tables respectively mean parts by weight and wt %.

Component X Containing the Organic Sulfonic Acid Compound (C)

Component X-1

HOSTAPUR SAS93 (containing 93 wt % of the organic sulfonic acid compound (C), produced by Hoechst) was used as Component X-1 containing the organic sulfonic acid compound (C). Component X-1 contained considerable amount of Glauber's salt. The amounts of sulfate ion ($SO_4^{2-}$) and chlorine ion (CO in Component X-1 were measured by ion chromatography respectively into 23950 ppm for sulfate ion and 62 ppm for chlorine ion to the organic sulfonic acid compound (C).

Component X-2

Melsolat H95 (containing 95 wt % of the organic sulfonic acid compound (C), produced by Bayer) was used as Component X-2 containing the organic sulfonic acid compound (C). Component X-2 contained considerable amount of sodium chloride. The amounts of sulfate ion ($SO_4^{2-}$) and chlorine ion (CO in Component X-2 were measured by ion chromatography respectively into 820 ppm for sulfate ion and 30170 ppm for chlorine ion to the organic sulfonic acid compound (C).

Preparation of Component Y Containing the Organic Sulfonic Acid Compound (C)

Components Y-1 and Y-2, which contained the organic sulfonic acid compound (C), were prepared by refining and removing inorganic substances from the above-mentioned Components X-1 and X-2. The inorganic substances can be removed from the components in a known process, which is not restricted within the scope of the refining process in Examples.

Preparation of Component Y-1

550 parts of methanol and 400 parts of deionized water were mixed and conditioned at 45±5° C. Then 700 parts of Component X-1 was gradually added with agitation to be completely dissolved. Then the solution was stood still at room temperature for twenty hours to precipitate Glauber's salt. The supernatant liquid containing no Glauber's salt was taken out and distilled under reduced pressure at 60 to 80° C. to remove part of methanol and water and obtain Component Y-1 containing 70 wt % of the organic sulfonic acid compound (C).

The amounts of sulfate ion ($SO_4^{2-}$) and chlorine ion (CO in Component Y-1 were measured by ion chromatography respectively into 1085 ppm for sulfate ion and 60 ppm for chlorine ion to the organic sulfonic acid compound (C).

Preparation of Component Y-2

600 parts of deionized water was heated to 80±5° C. and 400 parts of Component X-2 was gradually added with agitation to be completely dissolved. Then the solution was cooled down to 40° C., and sodium chloride was removed with ion-exchange resin to obtain Component Y-2 containing 40 wt % of the organic sulfonic acid compound (C).

The amounts of sulfate ion ($SO_4^{2-}$) and chlorine ion ($Cl^-$) in Component Y-2 were measured by ion chromatography respectively into 105 ppm for sulfate ion and 2115 ppm for chlorine ion to the organic sulfonic acid compound (C).

Examples 1 to 25 and Comparative Examples 1 to 17

The components shown in Tables 1 to 5 described below were formulated to be prepared into the nonvolatile component of each of the synthetic fiber finishes of Examples and Comparative examples. The codes in Tables 1 to 5 represent the substances shown below. The numbers given in the rows of the nonvolatile component in Tables 1 to 5 represent the percent by weight of each component (or the nonvolatile component of Components X and Y) to the nonvolatile component of the finish.

A1-1: 2-ethylhexyl palmitate
A1-2: isotridecyl stearate
A1-3: oleyl oleate
A1-4: octyldodecyl stearate
A2-1: 1,6-hexanediol dioleate
A2-2: dioleyl adipate
A2-3: glycerin trioleate
A2-4: trimethylolpropane trilaurate
A2-5: pentaerythritol tetraoleate
A2-6: diglycerin tetraoleate
A2-7: sorbitan tetrastearate
A3-1: dioleyl thiodipropionate
A3-2: diisocetylalcohol thiodipropionate
A3-3: hexane diol dioctadecyl thiopropionate
A3-4: trimethylolpropane tridecyl thiopropionate
B-1: diglycerin dioleate
B-2: glycerin monooleate
B-3: glycerin monostearate
B-4: polyglycerin dioleate
B-5: sorbitan monooleate
B-6: sorbitan sesquioleate
D-1: EO/PO (50:50) stearyl polyether, M.W. 1600, random copolymer
D-2: EO/PO (40:60) 2-ethylhexyl polyether, M.W. 1700, block copolymer
D-3: EO/PO (70:30) sec-$C_{12}$, $C_{14}$ alkyl polyether, M.W. 650, block copolymer
D-4: EO/PO (50:50) isobutyl polyether, M.W. 1800, random copolymer
D-5: EO/PO (75:25) lauryl polyether, M.W. 850, random copolymer
E-1: POE (3) $C_{12}$-$C_{13}$ alkyl decanoate
E-2: EO/PO (75:25) $C_{12}$-$C_{13}$ alkyl laurate
E-3: EO/PO (75:25) decyl octanoate
F-1: Condensation product of POE (25) hydrogenated castor oil ether with maleic acid and stearic acid
F-2: POE (25) hydrogenated castor oil triisostearate
F-3: POE (20) hydrogenated castor oil trioleate
F-4: POE (20) hydrogenated castor oil ether
F-5: POE (20) glycerin trioleate
H-1: Diglycerin
H-2: Sorbitan
G-1: Isocetyl phosphate-stearyl amine salt
G-2: POE (3) $C_{12}$-$C_{13}$ phosphate-POE (10) laurylaminoether salt
G-3: POE (3) $C_{12}$-$C_{13}$ phosphate-POE (3) oleylaminoether salt
G-4: Isostearyl phosphate-dibutylethanol amine salt The amounts of the total sulfuric acid, sulfate ion and chlorine ion in the nonvolatile components of the finishes in Tables 1 to 5 were determined by the following methods.

Total sulfuric acid in the nonvolatile component of a finish

The amount of the total sulfuric acid in the nonvolatile component of a finishes was determined in the following procedure with the reagents described below.

Reagents (1) Decomposition agent (5% conc. potassium carboxylate solution): 50 g of potassium carboxylate (JIS K-8615, Reagent grade) was dissolved in deionized water and diluted to 1 liter.

(2) Potassium sulfate (JIS K-8962, Reagent grade) was ignited at 750° C. for 1 hour, and 2.1765 g of the ignited potassium sulfate was dissolved in deionized water and diluted to 1 liter. The solution contains 1000 ppm of $SO_3$.

Procedure (1) Weigh 1 g of a sample (the nonvolatile component of a finish) accurately in a crucible.

(2) Add 5 mL of the decomposition agent with a measuring cylinder.

(3) Place a round filter paper having a diameter a little longer than the crucible diameter into the crucible so as to cover the sample and agent.

(4) Heat the crucible on an electric heater, and set fire to the filter paper with a lighter when fume is generated from the sample being decomposed.

(5) After the sample is burnt out, incinerate the sample completely at 800° C. in an electric furnace. If the sample cannot be incinerated at the temperature, raise the temperature to 850° C.

(6) Take out the sample after 30 minute incineration and cool down the sample to room temperature. Then dissolve the incinerated sample in water and transfer the solution to a measuring flask.

(7) Condition the solution at 20° C. for 3 hours to prepare the sample solution.

(8) Analyze the standard sulfuric acid solution and the sample solution by ion chromatography.

(9) Determine the total sulfuric acid in the sample by comparing the ion chromatographic data of the sample to the calibration curve prepared with the data obtained in the ion chromatography analysis of the standard sulfuric acid solution.

Sulfate ion ($SO_4^{2-}$) and chlorine ion ($Cl^-$) in the nonvolatile component of a finish The amounts of the sulfate ion ($SO_4^{2-}$) and chlorine ion ($Cl^-$) in the nonvolatile component of a finish were determined in the following procedure.

A solution sample was prepared by accurately weighing 5 g of a sample (the nonvolatile component of a finish) in a 100-mL measuring flask, adding 95 g of ultrapure water gradually with agitation to dissolve the sample, to obtain constant volume 100 mL. 2 mL of the solution was filtered through an ODS (octadecylsilane) pre-treatment cartridge to remove lipophilic substances before ion chromatography analysis. The ions were detected in ion chromatography under the conditions shown below. The ratio of the peak areas of the detected ions to the peak area of the standard solution of known concentration was determined, and converted into the amounts of the sulfate ion ($SO_4^{2-}$) and chlorine ion ($Cl^-$). The limit of the quantitative analysis was 0.6 ppm for sulfate ion ($SO_4^{2-}$) and 1.0 ppm for chlorine ion ($Cl^-$).

Conditions for the Ion Chromatography

Device: ICS-1500, with a suppressor, manufactured by Dionex

Analysis column: Dionex IonPac AS14, 4.0 mm in inside diameter and 50 mm long

Guard column: Dionex IonPac AG14, 4.0 mm in inside diameter and 250 mm long

Mobile phase: 3.5 mmol of $Na_2CO_3$, 1.0 mmol of $NaHCO_3$

Flow rate: 1.5 mL/min

Each of the nonvolatile components and $C_{13}$ paraffin oil were mixed in 1 to 1 weight ratio to prepare each synthetic fiber finish.

A nylon 6,6 filament strand (470 dtex, 68f) of circular cross-sectional filament was melt-spun and applied with each of the prepared finishes by a jet nozzle to 1 wt % of the filament strand. Then each of the filament strands were directly drawn on hot rolls at 210° C. in multistage drawing with 5 times draw ratio and taken up to be prepared into synthetic filament strands for airbags. The synthetic filament strands for airbags were tested to determine the drawing performance of the filament, fume generation on draw rolls, stain on the draw rolls and removability of the finish from the filament. The result is shown in Tables 1 to 5.

Drawing Performance of Filament

The surface of the 10 kg-bobbin of a filament strand taken up at 3000 m/min after spinning and drawing was inspected, and the number of broken filament of 1 mm or longer was counted to evaluate the drawing performance of the filament.

A: 0 to 9 broken filaments

B: 10 to 19 broken filaments

C: 20 or more of broken filament

Fume Generation on Draw Rolls

The fume generation on draw rolls was visually inspected in spinning and drawing.

A: no fume generation

B: almost no fume generation

C: much fume generation

Stain on draw rolls

The stain on draw rolls was visually inspected in the spinning and drawing.

A: no stain on draw rolls

B: almost no stain on draw rolls

C: much stain on draw rolls

Removability of Finish from Filament

Each of the resultant synthetic filament strands for airbags was knitted into knit fabric with a circular knitting machine. 10 g of the knit fabric was taken and immersed for 1 minute in 300 g of water at 20° C. After the immersion, the fabric sample was dehydrated with a centrifugal dehydrator for 1 minute, and dried in an oven at 105° C. for 90 minutes to remove water from the fabric. The mass of the dried fabric (5-1) was measured by an electronic analytical scale and then the fabric was put into a Soxhlet extractor. Cyclohexane was poured into the extractor and the extractor was heated to reflux the cyclohexane about 4 hours. Then the cyclohexane was recovered and the bone-dry weight (M−1) of the resultant extract was measured. The residual finish in the knit fabric (%) was calculated by the following expression.

$$\text{Residual finish (\%)}=(M-1)/(S-1)\times 100$$

The removed finish was calculated from the amount of the finish applied to the filament in spinning and the residual finish by the following expression.

$$\text{Removed finish (\%)}=100-(\text{Residual finish})/(\text{Amount of finish applied to filament})\times 100$$

If the removed finish is 70% or more, the finish can be readily removed from the filament strand by water jet in weaving airbag fabric with a water-jet loom, or readily removed from air bag fabric in scouring.

Then each of the resultant synthetic filament strands for airbags was woven with a water-jet loom into plain weave airbag fabric into the density of 54 warp threads/2.54 cm and 54 weft threads/2.54 cm. The airbag fabric was then tested to determine the residual finish, yarn-to-yarn static friction, slippage resistance (edgecomb resistance) and adhesiveness of a silicone resin to the fabric.

Residual Finish

About 300 g of an airbag fabric was sampled and dried in an oven at 105° C. for 90 minutes. Then the mass of the dried fabric (S-2) was measured by an electronic analytical scale and the fabric was put into a large Soxhlet extractor. About 2 L of cyclohexane was poured into the extractor and the extractor was heated to reflux the cyclohexane about 4 hours. Then the cyclohexane was recovered and the bone-dry weight (M-2) of the resultant extract was measured. The residual finish in the airbag fabric (%) was calculated by the following expression.

$$\text{Residual finish (\%)}=(M-2)/(S-2)\times 100$$

Yarn-to-Yarn Static Friction

The warp and weft were pulled out from the airbag fabric, and were tested to measure the yarn-to-yarn static friction with the tester shown in FIG. 1. The measurement was conducted with the initial yarn tension of T1 (g) given by the load and three turns of twist given to the tested yarn. The yarn was pulled at the velocity of 3 cm/min to determine the pulling tension T2 (g). The ratio of T2/T1 was defined as the yarn-to-yarn static friction. Thus higher T2/T1 indicates higher yarn-to-yarn static friction while lower T2/T1 indicates lower yarn-to-yarn static friction.

T2/T1 should preferably not lower than 2.75 for improved slippage resistance of the airbag fabric.

Slippage Resistance of Airbag Fabric (Edgecomb Resistance)

The slippage resistance of the airbag fabrics was tested according to ASTM D6479. A test piece 5 cm wide and 30 cm long was cut out from an airbag fabric, and the warp and weft were pulled at the velocity of 200 mm/min to measure the slippage resistance of the fabric. Higher slippage resistance indicates better airtightness of the fabric in the form of an airbag.

A: slippage resistance of at least 450 N

B: slippage resistance of at least 400 N

C: slippage resistance of at least 300 N and less than 400 N

D: slippage resistance of less than 300 N

Adhesiveness of a Silicone Resin to Airbag Fabric

Each of the airbag fabrics was coated with a solvent-free methylvinyl silicone resin with 12000 mPa·s viscosity to the thickness of 15 g/m$^3$ using a floating-knife coater equipped with a flat-edge knife, and vulcanized at 160° C. for 2 minutes to be processed into a silicone-coated airbag fabric.

The resultant silicone-coated airbag fabric was tested in the crease and flex test with a Scott Crease-Flex Abrasion Tester according to JIS K-6404-6, and the adhesiveness of the silicone resin to fabric after 500 times of the crease and flex operation was evaluated as follows.

A: no detachment of the silicone resin

B: detachment of small amount of the silicone resin

C: detachment of about half of the silicone resin

D: detachment of all of the silicone resin

TABLE 1

| | | | Example | | | | | | | |
|---|---|---|---|---|---|---|---|---|---|---|
| | | | 1 | 2 | 3 | 4 | 5 | 6 | 7 | 8 |
| Nonvolatile component | Lubricant (A) | A1-1 | | | 10 | | | | | |
| | | A1-2 | | | | 10 | | | | |
| | | A1-3 | 10 | 10 | | | 10 | | | |
| | | A1-4 | | | | | | 10 | | |
| | | A2-1 | | | 40 | | | | | 40 |
| | | A2-2 | | | | 40 | | | | |
| | | A2-3 | 15 | 14 | | | 40 | | | |
| | | A2-4 | 24 | 22 | | | | 40 | | |
| | | A2-5 | | | | | | | 50 | |
| | | A3-1 | 10 | 10 | | | | 10 | | |
| | | A3-2 | | | 5 | | | | 10 | |
| | | A3-3 | | | | 5 | | | | 10 |
| | | A3-4 | | | | | 5 | | | |
| | Polyhydric alcohol fatty acid ester having at least one hydroxyl group per molecule (B) | B-1 | 5 | 5 | | | | | | 20 |
| | | B-2 | | | 5 | | | | | |
| | | B-3 | | | | 10 | | | | |
| | | B-4 | | | | | 20 | | | |
| | | B-5 | | | | | | 5 | | |
| | | B-6 | | | | | | | 10 | |
| | Components containing the organic sulfonic acid compound (C) | X-1 | | | | | | | | |
| | | X-2 | | | | | | | | |
| | | Y-1 | 1 | 3 | 2 | 2 | 2 | | 2 | |
| | | Y-2 | | | | | | 1 | | 1 |
| | Alkyl polyether (D) | D-1 | 23 | 21 | | | | | 16 | |
| | | D-2 | | | 20 | | | | | 15 |
| | | D-3 | | | | 20 | | | | |
| | | D-4 | | | | | 14 | | | |
| | | D-5 | | | | | | 20 | | |
| | Other components | E-1 | 5 | 5 | | | 5 | | | 6 |
| | | E-2 | | | 8 | | | 5 | | |
| | | E-3 | | | | 5 | | | 5 | |
| | | F-1 | 5 | 5 | | | | | 5 | |
| | | F-2 | | | 7 | | | | | 5 |
| | | F-3 | | | | 5 | | | | |
| | | F-4 | | | | | 3 | | | |
| | | F-5 | | | | | | 7 | | |
| | | G-1 | | | 3 | | | | 2 | |
| | | G-2 | 2 | | | 3 | | | | 3 |
| | | G-3 | | 5 | | | 1 | | | |
| | | G-4 | | | | | | 2 | | |
| Amount of the lubricant (A) (wt %) | | | 59 | 56 | 55 | 55 | 55 | 60 | 60 | 50 |
| Amount of the sulfur-containing ester (A3) (wt %) | | | 10 | 10 | 5 | 5 | 5 | 10 | 10 | 10 |
| Amount of the ester (B) (wt %) | | | 5 | 5 | 5 | 10 | 20 | 5 | 10 | 20 |
| Amount of total sulfuric acid in the nonvolatile component of the finish (%) | | | 0.83 | 1.00 | 0.72 | 1.10 | 1.59 | 1.02 | 1.28 | 2.10 |
| Sulfate ion in the nonvolatile component of the finish (ppm) | | | 44 | 39 | 23 | 22 | 24 | 3 | 25 | 4 |
| Chlorine ion in the nonvolatile component of the finish (ppm) | | | 11 | 13 | 2 | 3 | 3 | 22 | 3 | 43 |
| Result of the test | Heat resistance | Drawing performance | A | A | A | A | A | A | A | A |
| | | Fume generation | A | A | A | A | A | A | A | A |
| | | Stain on draw rolls | A | A | A | A | A | A | A | A |
| | Removability of finish (%) | | 83.0 | 87.5 | 84.3 | 85.1 | 78.5 | 82.2 | 77.0 | 76.7 |
| | Residual finish (%) | | 0.06 | 0.04 | 0.05 | 0.06 | 0.12 | 0.05 | 0.13 | 0.13 |
| | Adhesiveness of silicone resin | | A | A | A | B | B | B | B | B |
| | Yarn-to-yarn static friction (warp) | | 3.10 | 3.20 | 3.00 | 3.12 | 2.95 | 3.03 | 2.98 | 2.94 |
| | Yarn-to-yarn static friction (weft) | | 3.05 | 3.10 | 3.08 | 3.20 | 2.93 | 3.01 | 2.84 | 2.91 |
| | Slippage resistance of airbag fabric | | A | A | A | A | B | A | B | B |

TABLE 2

| | | | Examples | | | | | | | |
|---|---|---|---|---|---|---|---|---|---|---|
| | | | 9 | 10 | 11 | 12 | 13 | 14 | 15 | 16 |
| Nonvolatile component | Lubricant (A) | A1-1 | 10 | | | | | | | 9 |
| | | A1-2 | | | 5 | | | | | |
| | | A1-3 | | | | | 10 | | | |
| | | A1-4 | | | | | | 20 | | |

TABLE 2-continued

| | | | Examples | | | | | | | |
|---|---|---|---|---|---|---|---|---|---|---|
| | | | 9 | 10 | 11 | 12 | 13 | 14 | 15 | 16 |
| | | A2-1 | | | | | 70 | | | 70 |
| | | A2-2 | 30 | | | | | 60 | 80 | |
| | | A2-3 | | 40 | | | | | | |
| | | A2-4 | | | 30 | | | | | |
| | | A2-5 | | | | 74 | | | | |
| | | A3-1 | | 20 | | 5 | | | | |
| | | A3-2 | | | 20 | | 5 | | | |
| | | A3-3 | | | | | | 5 | 5 | |
| | | A3-4 | 20 | | | | | | | 10 |
| | Polyhydric alcohol fatty acid ester having at least one hydroxyl group per molecule (B) | B-1 | | | | | | 5 | 5 | |
| | | B-2 | 5 | | | | | | | 10 |
| | | B-3 | | 10 | | | | | | |
| | | B-4 | | | 20 | | | | | |
| | | B-5 | | | | 5 | | | | |
| | | B-6 | | | | | 5 | | | |
| | Components containing the organic sulfonic acid compound (C) | X-1 | | | | | | | | |
| | | X-2 | | | | | | | | |
| | | Y-1 | 1 | | 1 | 1 | | 5 | | |
| | | Y-2 | | 2 | | | 3 | | 10 | 1 |
| | Alkyl polyether (D) | D-1 | | | | 15 | | | | |
| | | D-2 | | | | | | | | |
| | | D-3 | 21 | | | | | | | |
| | | D-4 | | 15 | | | | | | |
| | | D-5 | | | 12 | | | | | |
| | Other components | E-1 | | | 5 | | | | | |
| | | E-2 | 5 | | | | 7 | | | |
| | | E-3 | | 5 | | | | | | |
| | | F-1 | | | | | | | | |
| | | F-2 | | | | | | | | |
| | | F-3 | 5 | | | | | | | |
| | | F-4 | | 5 | | | | | | |
| | | F-5 | | | 5 | | | | | |
| | | G-1 | | | 2 | | | | | |
| | | G-2 | | | | | | 5 | | |
| | | G-3 | 3 | | | | | | | |
| | | G-4 | | 3 | | | | | | |
| Amount of the lubricant (A) (wt %) | | | 60 | 60 | 55 | 79 | 85 | 85 | 85 | 89 |
| Amount of the sulfur-containing ester (A3) (wt %) | | | 20 | 20 | 20 | 5 | 5 | 5 | 5 | 10 |
| Amount of the ester (B) (wt %) | | | 5 | 10 | 20 | 5 | 5 | 5 | 5 | 10 |
| Amount of total sulfuric acid in the nonvolatile component of the finish (%) | | | 5.58 | 2.30 | 0.86 | 0.58 | 0.84 | 1.52 | 2.03 | 2.87 |
| Sulfate ion in the nonvolatile component of the finish (ppm) | | | 15 | 6 | 44 | 12 | 4 | 56 | 5 | 2 |
| Chlorine ion in the nonvolatile component of the finish (ppm) | | | 3 | 44 | 11 | 1 | 64 | 5 | 110 | 21 |
| Result of the test | Heat resistance | Drawing performance | A | A | A | A | A | A | A | A |
| | | Fume generation | A | A | A | A | A | A | A | A |
| | | Stain on draw rolls | A | A | A | A | A | A | A | A |
| | Removability of finish (%) | | 81.3 | 76.9 | 75.0 | 76.4 | 73.3 | 74.1 | 82.0 | 72.0 |
| | Residual finish (%) | | 0.05 | 0.14 | 0.14 | 0.13 | 0.15 | 0.14 | 0.07 | 0.15 |
| | Adhesiveness of silicone resin | | B | B | A | A | A | B | B | B |
| | Yarn-to-yarn static friction (warp) | | 3.01 | 2.84 | 2.80 | 2.88 | 2.80 | 2.98 | 3.02 | 2.82 |
| | Yarn-to-yarn static friction (weft) | | 3.11 | 2.86 | 2.86 | 2.80 | 2.79 | 2.86 | 3.05 | 2.86 |
| | Slippage resistance of airbag fabric | | A | B | B | B | B | B | A | B |

TABLE 3

| | | | Examples | | | | | | | | |
|---|---|---|---|---|---|---|---|---|---|---|---|
| | | | 17 | 18 | 19 | 20 | 21 | 22 | 23 | 24 | 25 |
| Nonvolatile component | Lubricant (A) | A1-1 | | | | | | 10 | | | |
| | | A1-2 | 7 | | | | | | | | |
| | | A1-3 | | 5 | | | | | | | |
| | | A1-4 | | | 10 | 10 | | | | | |
| | | A2-1 | | | | | | 45 | | | |
| | | A2-2 | 70 | | | | | | 50 | 60 | |
| | | A2-3 | | 70 | 60 | | | | | | 60 |
| | | A2-4 | | | | 49 | | | | | |
| | | A2-5 | | | | | 57 | | | | |
| | | A3-1 | 10 | | | | | 20 | | 10 | |
| | | A3-2 | | 10 | 10 | | | | 20 | | 10 |
| | | A3-3 | | | | 20 | | | | | |
| | | A3-4 | | | | | 20 | | | | |

TABLE 3-continued

| | | | Examples | | | | | | | | |
|---|---|---|---|---|---|---|---|---|---|---|---|
| | | | 17 | 18 | 19 | 20 | 21 | 22 | 23 | 24 | 25 |
| | Polyhydric alcohol fatty acid ester having at least one hydroxyl group per molecule (B) | B-1 | | | | | | 20 | | | |
| | | B-2 | | | | | | | 20 | | |
| | | B-3 | 10 | | | | | | | 10 | |
| | | B-4 | | 10 | 10 | | | | | | 10 |
| | | B-5 | | | | 20 | | | | | |
| | | B-6 | | | | | 20 | | | | |
| | Components containing the organic sulfonic acid compound (C) | X-1 | | | | | | | | 2 | |
| | | X-2 | | | | | | | | | 2 |
| | | Y-1 | 3 | | 10 | 1 | | 5 | | | |
| | | Y-2 | | 5 | | | 3 | | 10 | | |
| | Alkyl polyether (D) | D-1 | | | | | | | | 18 | |
| | | D-2 | | | | | | | | | 18 |
| Amount of the lubricant (A) (wt %) | | | 87 | 85 | 80 | 79 | 77 | 75 | 70 | 70 | 70 |
| Amount of the sulfur-containing ester (A3) (wt %) | | | 10 | 10 | 10 | 20 | 20 | 20 | 20 | 10 | 10 |
| Amount of the ester (B) (wt %) | | | 10 | 10 | 10 | 20 | 20 | 20 | 20 | 10 | 10 |
| Amount of total sulfuric acid in the nonvolatile component of the finish (%) | | | 1.41 | 1.47 | 2.03 | 4.10 | 5.75 | 2.40 | 2.93 | 1.12 | 1.23 |
| Sulfate ion in the nonvolatile component of the finish (ppm) | | | 33 | 7 | 112 | 16 | 8 | 59 | 14 | 480 | 17 |
| Chlorine ion in the nonvolatile component of the finish (ppm) | | | 2 | 108 | 8 | 4 | 66 | 5 | 219 | 3 | 605 |
| Results of the test | Heat resistance | Drawing performance | A | A | A | A | A | A | A | A | A |
| | | Fume generation | A | A | A | A | A | A | A | A | A |
| | | Stain on draw rolls | A | A | A | A | A | A | A | A | A |
| | Removability of finish (%) | | 73.0 | 76.5 | 80.3 | 73.3 | 75.7 | 73.9 | 81.4 | 74.9 | 75.3 |
| | Residual finish (%) | | 0.15 | 0.14 | 0.06 | 0.15 | 0.13 | 0.14 | 0.05 | 0.11 | 0.12 |
| | Adhesiveness of silicone resin | | B | B | B | B | B | B | B | B | B |
| | Yarn-to-yarn static friction (warp) | | 2.80 | 2.85 | 3.04 | 2.82 | 2.86 | 2.96 | 2.99 | 2.93 | 2.87 |
| | Yarn-to-yarn static friction (weft) | | 2.84 | 2.91 | 2.99 | 2.80 | 2.81 | 2.88 | 3.08 | 2.88 | 2.90 |
| | Slippage resistance of airbag fabric | | A | B | B | A | A | A | A | B | B |

TABLE 4

| | | | Comparative example | | | | | | | |
|---|---|---|---|---|---|---|---|---|---|---|
| | | | 1 | 2 | 3 | 4 | 5 | 6 | 7 | 8 |
| Nonvolatile component | Lubricant (A) | A1-1 | 10 | | | | | | | 20 |
| | | A1-2 | | | | 10 | | | | |
| | | A1-3 | | | | | 10 | | | |
| | | A1-4 | | | | | | | 10 | |
| | | A2-1 | 40 | | | | | 40 | | |
| | | A2-2 | | 50 | | | | | 55 | |
| | | A2-3 | | | 50 | | | | | 10 |
| | | A2-4 | | | | 40 | | | | |
| | | A2-5 | | | | | 50 | 10 | | |
| | | A3-1 | 10 | | | | | | | |
| | | A3-2 | | 10 | | | | | | 10 |
| | | A3-3 | | | | 10 | | | | |
| | | A3-4 | | | | | | 10 | | |
| | Polyhydric alcohol fatty acid ester having at least one hydroxyl group per molecule (B) | B-1 | | | | | | | | 5 |
| | | B-2 | | | | | | | | |
| | | B-3 | | | | | | | | |
| | | B-4 | | | | | | | | |
| | Components containing the organic sulfonic acid compound (C) | X-1 | | | | | | | | |
| | | X-2 | | | | | | | | |
| | | Y-1 | 1 | 2 | | | 3 | | | |
| | | Y-2 | | | | | | 2 | 3 | 2 |
| | Alkyl polyether (D) | D-1 | 15 | | | | | 20 | | |
| | | D-2 | | 15 | | | | | 15 | |
| | | D-3 | | | 12 | | | | | 20 |
| | | D-4 | | | | 22 | | | | |
| | | D-5 | | | | | 10 | | | |
| | Other compenents | E-1 | 6 | | | 5 | | | 5 | |
| | | E-2 | | 4 | | | 5 | | | 10 |
| | | E-3 | | | 5 | | | 10 | | |
| | | F-1 | 6 | | 5 | | | 5 | | 10 |
| | | F-2 | | 3 | | | | | 5 | |
| | | F-3 | | | 5 | | | | 5 | |
| | | F-4 | | | | 3 | | | | 10 |
| | | F-5 | | | | | 5 | | | |
| | | H-1 | 10 | | 20 | | 15 | | | |
| | | H-2 | | 15 | | 10 | | | | |
| | | G-1 | 2 | | | | 2 | | | |
| | | G-2 | | 1 | | | | 3 | | |

TABLE 4-continued

| | | | Comparative example | | | | | | | |
|---|---|---|---|---|---|---|---|---|---|---|
| | | | 1 | 2 | 3 | 4 | 5 | 6 | 7 | 8 |
| | | G-3 | | | 3 | | | | 2 | |
| | | G-4 | | | | | | | | 3 |
| Amount of the lubricant (A) (wt %) | | | 60 | 60 | 50 | 60 | 60 | 60 | 65 | 40 |
| Amount of the sulfur-containing ester (A3) (wt %) | | | 10 | 10 | 0 | 10 | 0 | 10 | 0 | 10 |
| Amount of the ester (B) (wt %) | | | 0 | 0 | 0 | 0 | 0 | 0 | 0 | 5 |
| Amount of total sulfuric acid in the nonvolatile component of the finish (%) | | | 1.06 | 1.26 | 0.00 | 2.05 | 0.35 | 2.97 | 0.30 | 1.09 |
| Sulfate ion in the nonvolatile component of the finish (ppm) | | | 15 | 25 | 0 | 2 | 34 | 4 | 3 | 3 |
| Chlorine ion in the nonvolatile component of the finish (ppm) | | | 2 | 3 | 2 | 1 | 2 | 44 | 65 | 46 |
| Result of the test | Heat resistance | Drawing performance | B | A | B | C | B | A | A | C |
| | | Fume generation | A | A | A | B | B | A | A | A |
| | | Stain on draw rolls | A | A | C | B | C | A | C | C |
| | Removability of finish (%) | | 68.3 | 67.7 | 65.1 | 74.9 | 69.0 | 76.6 | 75.8 | 78.9 |
| | Residual finish (%) | | 0.16 | 0.18 | 0.20 | 0.12 | 0.17 | 0.11 | 0.08 | 0.05 |
| | Adhesiveness to silicone resin | | C | C | D | C | C | C | C | B |
| | Yarn-to-yarn static friction (warp) | | 2.71 | 2.57 | 2.55 | 2.70 | 2.59 | 2.80 | 2.84 | 2.97 |
| | Yarn-to-yarn static friction (weft) | | 2.66 | 2.60 | 2.61 | 2.64 | 2.60 | 2.81 | 2.81 | 2.96 |
| | Slippage resistance of airbag fabric | | C | D | D | C | D | B | B | B |

TABLE 5

| | | | Comparative example | | | | | | | | |
|---|---|---|---|---|---|---|---|---|---|---|---|
| | | | 9 | 10 | 11 | 12 | 13 | 14 | 15 | 16 | 17 |
| Nonvolatile component | Lubricant (A) | A1-1 | | | | | | | | | |
| | | A1-2 | 10 | | | | | | | | |
| | | A1-3 | | | | | 10 | | | | |
| | | A1-4 | | | | | | 10 | | | |
| | | A2-1 | | | 20 | | | | | 70 | |
| | | A2-2 | | | | 60 | | | | | 70 |
| | | A2-3 | | | | | 20 | | | | |
| | | A2-4 | 10 | | | | | 40 | | | |
| | | A2-5 | | 40 | | | | | 60 | | |
| | | A3-1 | | | 20 | | | | | 10 | |
| | | A3-2 | | | | | 30 | | | | 10 |
| | | A3-3 | 20 | | | | | 10 | | | |
| | | A3-4 | | 10 | | | | | | | |
| | Polyhydric alcohol fatty acid ester having at least one hydroxyl group per molecule (B) | B-1 | | | | | | 10 | | | |
| | | B-2 | 10 | | | | | | 15 | | |
| | | B-3 | | 30 | | | | | | | |
| | | B-4 | | | 30 | 20 | 10 | | | | |
| | Components containing the organic sulfonic acid compound (C) | X-1 | | | | | | | | 2 | |
| | | X-2 | | | | | | | | | 2 |
| | | Y-1 | | | | 2 | 2 | | | | |
| | | Y-2 | | | 3 | | | | | | |
| | Alkyl polyether (D) | D-1 | | | 15 | 15 | | | | 18 | |
| | | D-2 | | | | | 8 | | | | 18 |
| | | D-3 | | | | | | 15 | | | |
| | | D-4 | 20 | | | | | | 15 | | |
| | | D-5 | | 5 | | | | | | | |
| | Other components | E-1 | | 5 | | | 8 | | | | |
| | | E-2 | | | 5 | | | 5 | | | |
| | | E-3 | 10 | | | | | | | | |
| | | F-1 | | 5 | | 3 | | | | | |
| | | F-2 | 5 | | 5 | | 10 | | | | |
| | | F-3 | | | | | | 8 | | | |
| | | F-4 | | | | | | | 10 | | |
| | | F-5 | 10 | | | | | | | | |
| | | G-1 | 5 | | | | 2 | | | | |
| | | G-2 | | 5 | | | | 2 | | | |
| | | G-3 | | | 2 | | | | | | |
| | | G-4 | | | | | | | | | |
| Amount of the lubricant (A) (wt %) | | | 40 | 50 | 40 | 60 | 60 | 60 | 60 | 80 | 80 |
| Amount of the sulfur-containing ester (A3) (wt %) | | | 20 | 10 | 20 | 0 | 30 | 10 | 0 | 10 | 10 |
| Amount of the ester (B) (wt %) | | | 10 | 30 | 30 | 20 | 10 | 10 | 15 | 0 | 0 |
| Amount of total sulfuric acid in the nonvolatile component of the finish (%) | | | 4.02 | 2.69 | 0.33 | 0.21 | 3.40 | 2.80 | 0.00 | 1.03 | 1.19 |
| Sulfate ion in the nonvolatile component of the finish (ppm) | | | 4 | 2 | 4 | 20 | 27 | 1 | 0 | 475 | 18 |
| Chlorine ion in the nonvolatile component of the finish (ppm) | | | 2 | 2 | 62 | 3 | 5 | 1 | 1 | 2 | 598 |
| Results of the test | Heat resistance | Drawing performance | C | B | B | A | A | A | A | A | A |
| | | Fume generation | A | C | C | A | B | A | A | A | A |
| | | Stain on draw rolls | B | C | A | C | C | B | C | A | A |

TABLE 5-continued

| | Comparative example | | | | | | | | |
|---|---|---|---|---|---|---|---|---|---|
| | 9 | 10 | 11 | 12 | 13 | 14 | 15 | 16 | 17 |
| Removability of finish (%) | 82.6 | 64.8 | 83.3 | 78.8 | 68.3 | 74.6 | 67.5 | 72.2 | 73.6 |
| Residual finish (%) | 0.06 | 0.17 | 0.08 | 0.13 | 0.16 | 0.12 | 0.16 | 0.13 | 0.12 |
| Adhesiveness of silicone resin | B | D | B | B | C | C | C | C | C |
| Yarn-to-yarn static friction (warp) | 3.06 | 2.65 | 3.06 | 2.86 | 2.63 | 2.82 | 2.65 | 2.81 | 2.76 |
| Yarn-to-yarn static friction (weft) | 3.04 | 2.66 | 3.08 | 2.76 | 2.55 | 2.87 | 2.60 | 2.78 | 2.80 |
| Slippage resistance of airbag fabric | B | D | B | B | C | B | D | B | B |

As shown in Tables 1 to 5, the synthetic filament strands applied with the finishes for airbag yarns of Examples 1 to 25 exhibited good drawing performance in spinning and the fabrics of those synthetic filament strands applied with the finishes for airbag yarns of Examples 1 to 25 resulted in optimum yarn-to-yarn static friction, high slippage resistance of airbag fabric and good adhesiveness of the silicone resin.

On the other hand, the synthetic filament strands applied with the finishes of Comparative examples 1 to 17 sometimes exhibited poor drawing performance in spinning and the fabrics of those synthetic filament strands applied with the finishes resulted in excessively low yarn-to-yarn static friction, low slippage resistance of airbag fabric and poor adhesiveness of the silicone resin.

INDUSTRIAL APPLICABILITY

The synthetic fiber finish of the present invention is preferable for synthetic filament strands manufactured into industrial textiles including tire cord fabric, seat belts, airbags, fish net and rope.

The invention claimed is:

1. A synthetic fiber finish comprising:

a lubricant (A);

a polyhydric alcohol fatty acid ester having at least one hydroxyl group per molecule (B); and an organic sulfonic acid compound (C);

wherein the lubricant (A) includes a sulfur-containing ester (A3); and wherein the amount of the lubricant (A) ranges from 50 to 90 wt %, the amount of the ester (B) ranges from 1 to 20 wt % and the amount of the sulfur-containing ester (A3) ranges from 5 to 20 wt %, to a nonvolatile component of the finish.

2. The synthetic fiber finish according to claim 1, wherein an amount of a total sulfuric acid in the nonvolatile component of the finish ranges from 0.1 to 3 wt %.

3. The synthetic fiber finish according to claim 1, wherein the nonvolatile component of the finish contains sulfate ion ($SO_4^{2-}$) and chlorine ion ($Cl^-$) respectively in an amount of not higher than 300 ppm being detected in the nonvolatile component of the finish by ion chromatography.

4. The synthetic fiber finish according to claim 1, wherein a polyhydric alcohol constituting the polyhydric alcohol fatty acid ester (B) contains at least one selected from diglycerin and triglycerin.

5. The synthetic fiber finish according to claim 1, wherein the finish contains an alkyl polyether (D).

6. The synthetic fiber finish according to claim 1, wherein the finish is applied to a synthetic fiber manufactured into airbags.

7. A synthetic filament strand produced by applying the synthetic fiber finish according to claim 1 to a base synthetic filament strand.

8. A process for producing a synthetic filament strand, the process comprising a step of applying the finish according to claim 1 to a base synthetic filament strand.

9. A textile product comprising the synthetic filament strand according to claim 7.

10. A textile product comprising the synthetic filament strand produced in the process according to claim 8.

11. The synthetic fiber finish according to claim 2, wherein the nonvolatile component of the finish contains sulfate ion ($SO_4^{2-}$) and chlorine ion ($Cl^-$) respectively in an amount of not higher than 300 ppm being detected in the nonvolatile component of the finish by ion chromatography.

12. The synthetic fiber finish according to claim 2, wherein a polyhydric alcohol constituting the polyhydric alcohol fatty acid ester (B) contains at least one selected from diglycerin and triglycerin.

13. The synthetic fiber finish according to claim 3, wherein a polyhydric alcohol constituting the polyhydric alcohol fatty acid ester (B) contains at least one selected from diglycerin and triglycerin.

14. The synthetic fiber finish according to claim 11, wherein a polyhydric alcohol constituting the polyhydric alcohol fatty acid ester (B) contains at least one selected from diglycerin and triglycerin.

15. The synthetic fiber finish according to claim 2, wherein the finish contains an alkyl polyether (D).

16. The synthetic fiber finish according to claim 3, wherein the finish contains an alkyl polyether (D).

17. The synthetic fiber finish according to claim 11, wherein the finish contains an alkyl polyether (D).

18. The synthetic fiber finish according to claim 4, wherein the finish contains an alkyl polyether (D).

19. The synthetic fiber finish according to claim 12, wherein the finish contains an alkyl polyether (D).

20. The synthetic fiber finish according to claim 13, wherein the finish contains an alkyl polyether (D).

* * * * *